United States Patent [19]

Hurst

[11] 4,392,241

[45] Jul. 5, 1983

[54] DIGITAL INTERFACE SYSTEM

[75] Inventor: Dennis P. Hurst, San Diego, Calif.

[73] Assignee: The United States of America as represented by the Secretary of the Navy, Washington, D.C.

[21] Appl. No.: 258,987

[22] Filed: Apr. 30, 1981

[51] Int. Cl.[3] ..... H04K 1/00

[52] U.S. Cl. ..... 455/26; 455/27

[58] Field of Search ..... 455/26-30, 455/8, 49-52; 370/44, 88; 364/200

[56] References Cited

U.S. PATENT DOCUMENTS

| | | | |
|---|---|---|---|
| 3,262,116 | 7/1966 | Hutchinson et al. | 455/50 |
| 3,879,582 | 4/1975 | White et al. | 370/44 |
| 3,964,056 | 6/1976 | Charpentier et al. | 364/200 |
| 3,970,994 | 7/1976 | Jenny | 340/172.5 |
| 3,993,997 | 11/1976 | Jackson | 455/51 |
| 4,034,346 | 7/1977 | Hostein | 364/200 |
| 4,047,162 | 9/1977 | Dorey et al. | 364/200 |
| 4,140,972 | 2/1979 | Enriquez et al. | 455/51 |
| 4,184,117 | 1/1980 | Lindner | 455/27 |
| 4,320,514 | 3/1982 | Haskell | 455/29 |

OTHER PUBLICATIONS

"Navy UHF Satellite Communication System Description", PME-106 (7/80), U.S. Naval Electronics Systems Command Publication.

*Primary Examiner*—Sal Cangialosi

*Attorney, Agent, or Firm*—Robert F. Beers; Ervin F. Johnston; Thomas Glenn Keough

[57] ABSTRACT

A system interfaces classified information for encryption and transmission over ultra high frequency (uhf) or high frequency (hf) bands and for receiving and decryption of uhf and hf information for relay to a tactical data unit or a vocoder unit. The uhf link is relayed by satellite while the hf link follows a more conventional path to provide for backup in case one link or the other somehow is disabled. Optionally, a uhf submarine-satellite information exchange capability system (SSIXS) is included when the rest of the system is not utilized.

3 Claims, 21 Drawing Figures

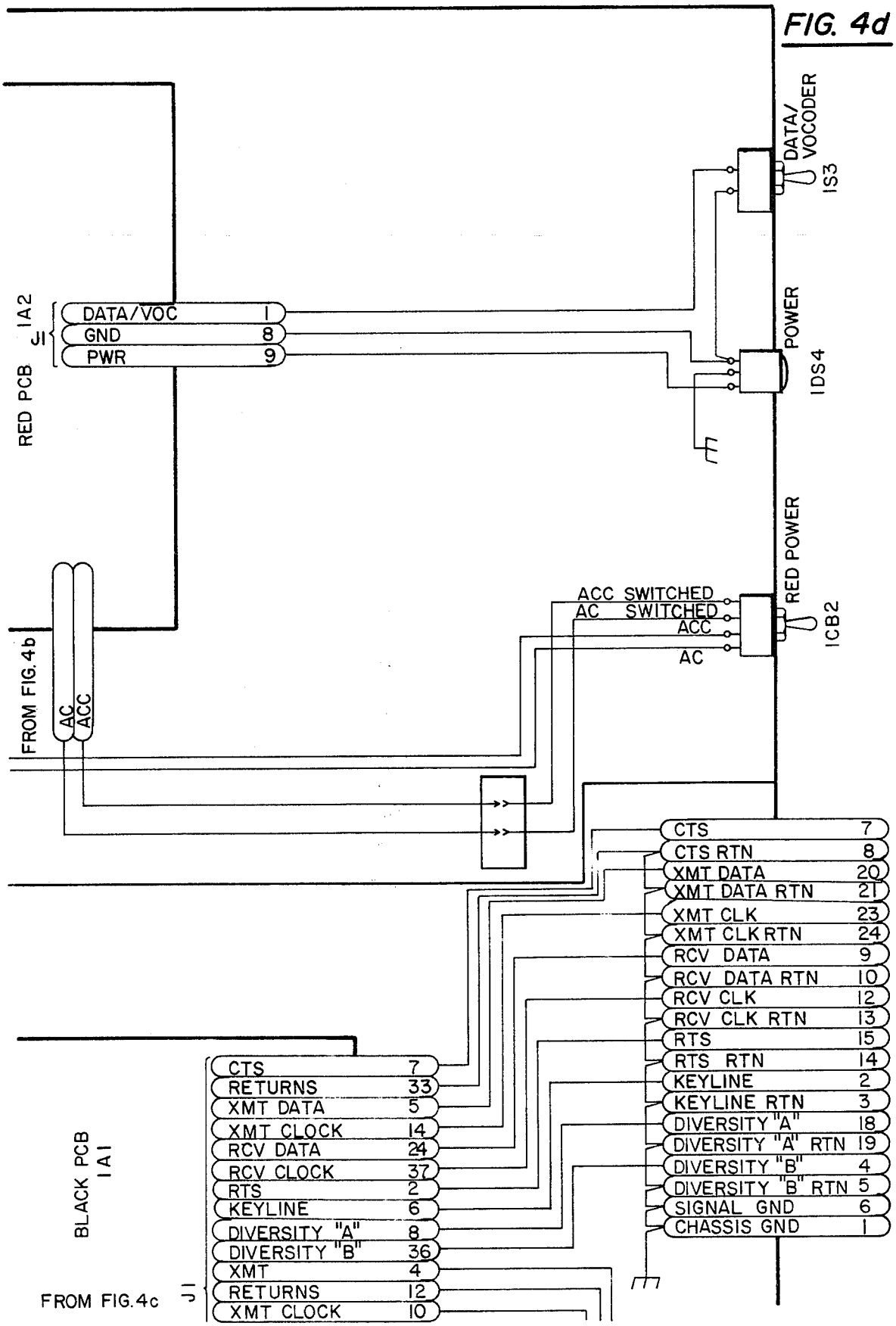
FIG. 4d
DATA/ VOCODER
1S3
POWER
1DS4
RED POWER
1CB2
RED PCB
1A2
J1
DATA/VOC 1
GND 8
PWR 9
FROM FIG. 4b
AC
ACC
ACC SWITCHED
AC SWITCHED
ACC
AC
CTS 7
CTS RTN 8
XMT DATA 20
XMT DATA RTN 21
XMT CLK 23
XMT CLK RTN 24
RCV DATA 9
RCV DATA RTN 10
RCV CLK 12
RCV CLK RTN 13
RTS 15
RTS RTN 14
KEYLINE 2
KEYLINE RTN 3
DIVERSITY "A" 18
DIVERSITY "A" RTN 19
DIVERSITY "B" 4
DIVERSITY "B" RTN 5
SIGNAL GND 6
CHASSIS GND 1
J7 HF RADIO
BLACK PCB
1A1
CTS 7
RETURNS 33
XMT DATA 5
XMT CLOCK 14
RCV DATA 24
RCV CLOCK 37
RTS 2
KEYLINE 6
DIVERSITY "A" 8
DIVERSITY "B" 36
XMT 4
RETURNS 12
XMT CLOCK 10
FROM FIG. 4c
J1

FROM FIG. 5a

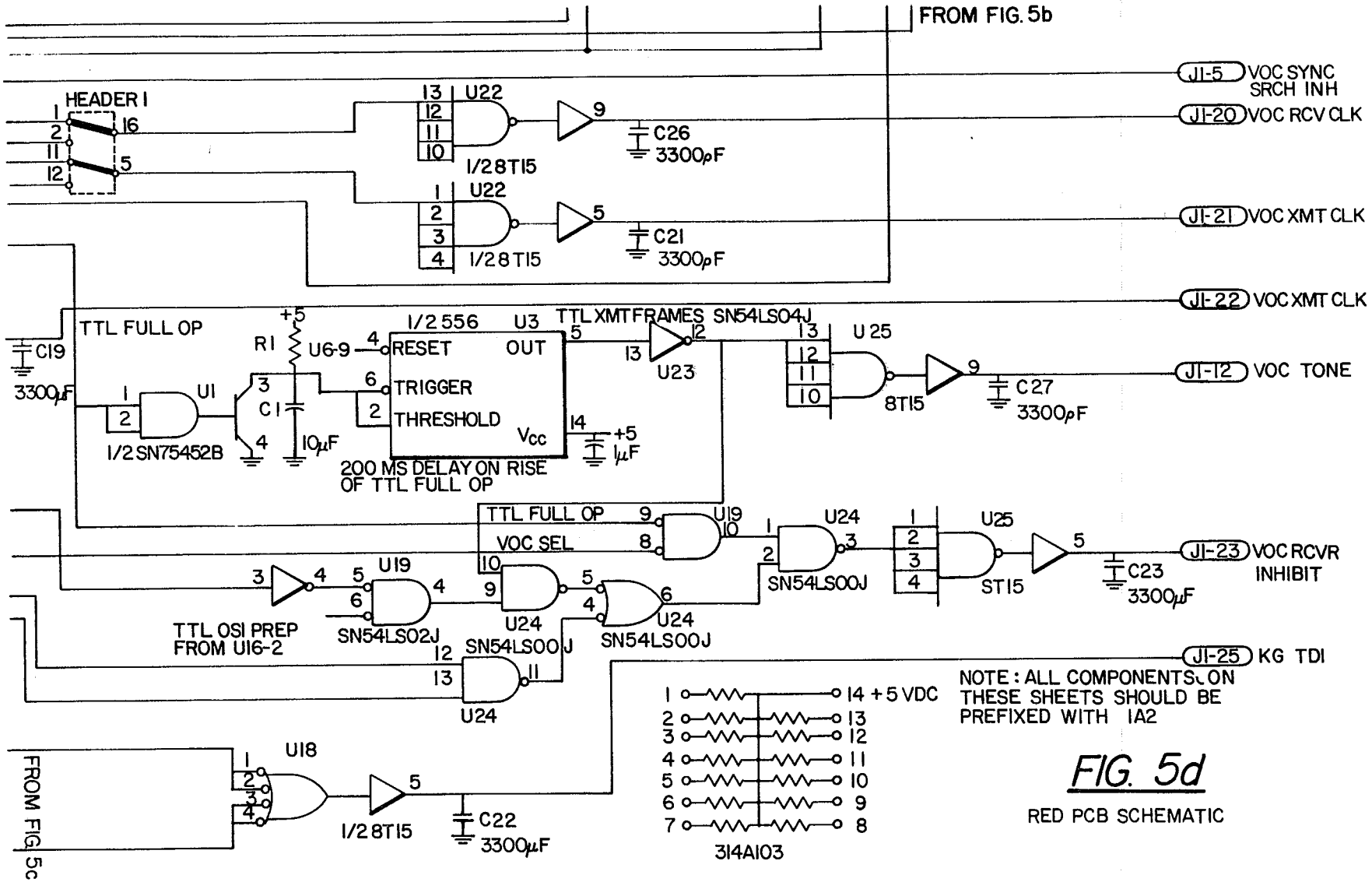
FROM FIG. 5b
J1-5 VOC SYNC SRCH INH
J1-20 VOC RCV CLK
J1-21 VOC XMT CLK
J1-22 VOC XMT CLK
J1-12 VOC TONE
J1-23 VOC RCVR INHIBIT
J1-25 KG TDI
C26 3300pF
C21 3300pF
C27 3300pF
C23 3300pF
C22 3300μF
C19 3300μF
U22 1/2 8T15
U25 8T15
U25 ST15
U24 SN54LS00J
U19 SN54LS02J
U23 SN54LS04J
U18 1/2 8T15
U1 1/2 SN75452B
U3 1/2 556
RESET
TRIGGER
THRESHOLD
OUT
Vcc
200 MS DELAY ON RISE OF TTL FULL OP
TTL XMT FRAMES
TTL FULL OP
VOC SEL
TTL OSI PREP FROM U16-2
HEADER 1
R1
C1
10μF
+5
1μF
14 +5 VDC
314A103
NOTE: ALL COMPONENTS ON THESE SHEETS SHOULD BE PREFIXED WITH 1A2
FIG. 5d
RED PCB SCHEMATIC
FROM FIG. 5c

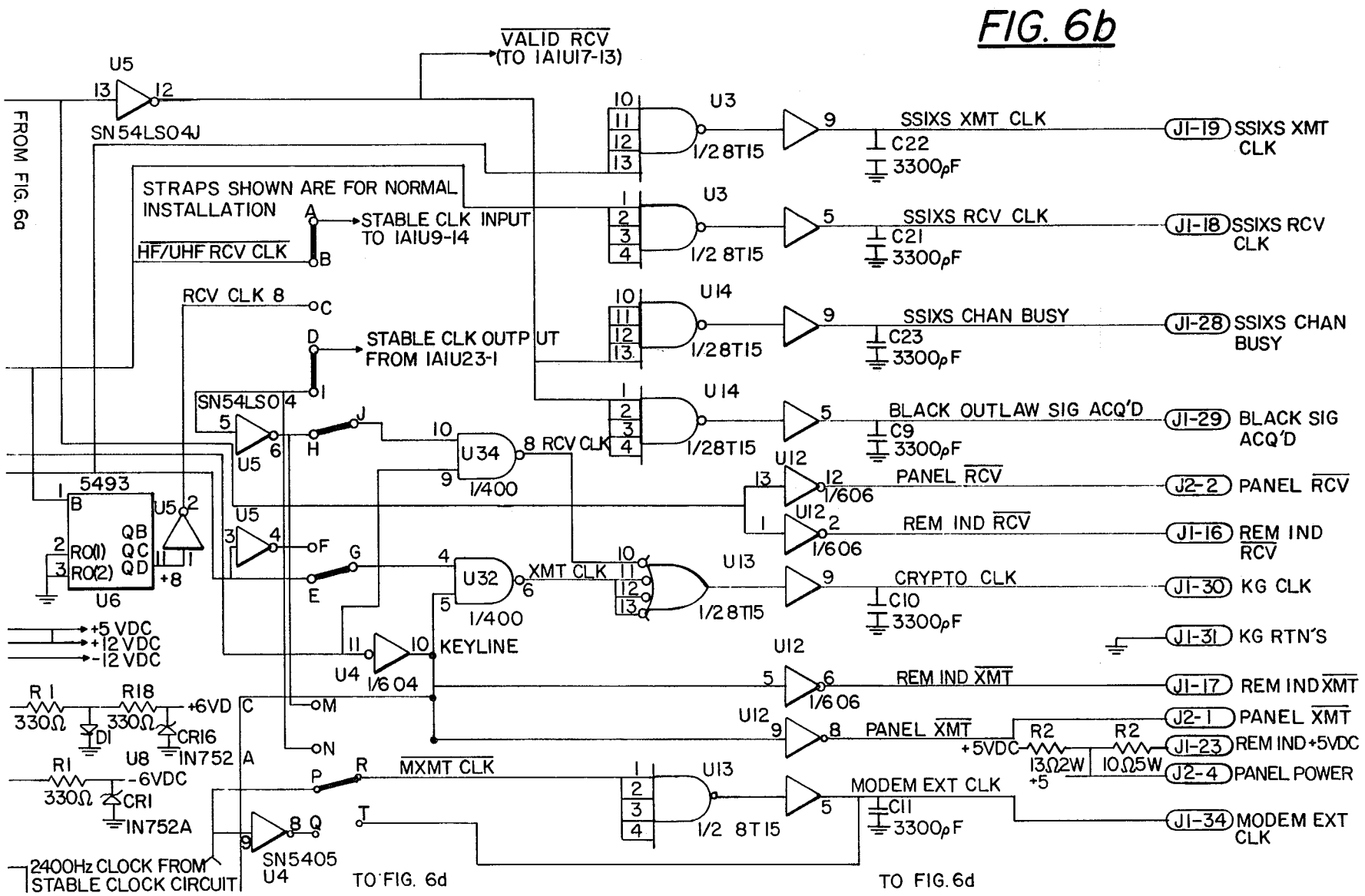
FIG. 6b
SSIXS XMT CLK
SSIXS RCV CLK
SSIXS CHAN BUSY
BLACK SIG ACQ'D
PANEL RCV
REM IND RCV
KG CLK
KG RTN'S
REM IND XMT
PANEL XMT
REM IND +5VDC
PANEL POWER
MODEM EXT CLK
J1-19
J1-18
J1-28
J1-29
J2-2
J1-16
J1-30
J1-31
J1-17
J2-1
J1-23
J2-4
J1-34
C22 3300pF
C21 3300pF
C23 3300pF
C9 3300pF
C10 3300pF
C11 3300pF
R2 10Ω.5W
R2 13Ω2W
+5VDC
+5
BLACK OUTLAW SIG ACQ'D
CRYPTO CLK
U3 1/2 8T15
U14 1/2 8T15
U13 1/2 8T15
U12 1/606
U34 1/400
U32 1/400
U4 1/604
U5 SN54LS04
U6 5493
U8 SN5405
VALID RCV (TO 1AIUI7-13)
STABLE CLK INPUT TO 1AIU9-14
STABLE CLK OUTP FROM 1AIU23-1
STRAPS SHOWN ARE FOR NORMAL INSTALLATION
HF/UHF RCV CLK
RCV CLK 8
8 RCV CLK
XMT CLK
KEYLINE
MXMT CLK
MODEM EXT CLK
TO FIG. 6d
TO FIG. 6d
+5 VDC
+12 VDC
-12 VDC
+6VDC
-6VDC
CR16 IN752
CR1 IN752A
R18 330Ω
R1 330Ω
D1
2400Hz CLOCK FROM STABLE CLOCK CIRCUIT
FROM FIG. 6a

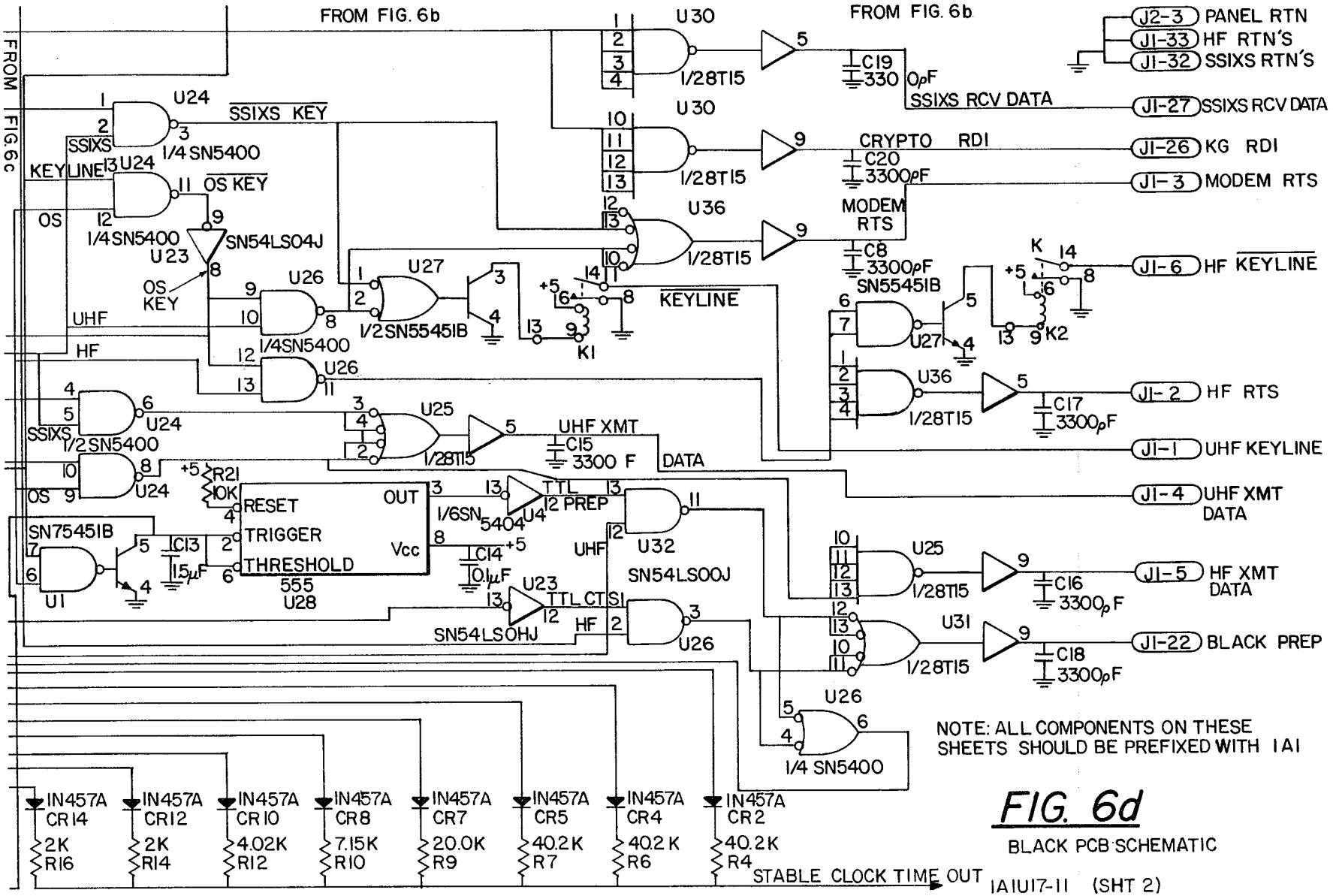
J2-3 PANEL RTN
J1-33 HF RTN'S
J1-32 SSIXS RTN'S
J1-27 SSIXS RCV DATA
J1-26 KG RDI
J1-3 MODEM RTS
J1-6 HF KEYLINE
J1-2 HF RTS
J1-1 UHF KEYLINE
J1-4 UHF XMT DATA
J1-5 HF XMT DATA
J1-22 BLACK PREP
NOTE: ALL COMPONENTS ON THESE SHEETS SHOULD BE PREFIXED WITH IAI
FIG. 6d
BLACK PCB SCHEMATIC
IAIUI7-II (SHT 2)
STABLE CLOCK TIME OUT
FROM FIG. 6b
FROM FIG. 6b
FROM FIG. 6c
SSIXS RCV DATA
CRYPTO RDI
MODEM RTS
KEYLINE
UHF XMT DATA
SSIXS KEY
OS KEY
OS KEY
U30 1/2 8T15
U36 1/2 8T15
U27 1/2 SN5451B
U26 1/4 SN5400
U24 1/4 SN5400
U23 SN54LS04J
U25 1/2 8T15
U32 SN54LS00J
U23 SN54LS04J
U28 555
U1 SN75451B
U31 1/2 8T15
U26 1/4 SN5400
IN457A CR2 40.2K R4
IN457A CR4 40.2K R6
IN457A CR5 40.2K R7
IN457A CR7 20.0K R9
IN457A CR8 7.15K R10
IN457A CR10 4.02K R12
IN457A CR12 2K R14
IN457A CR14 2K R16

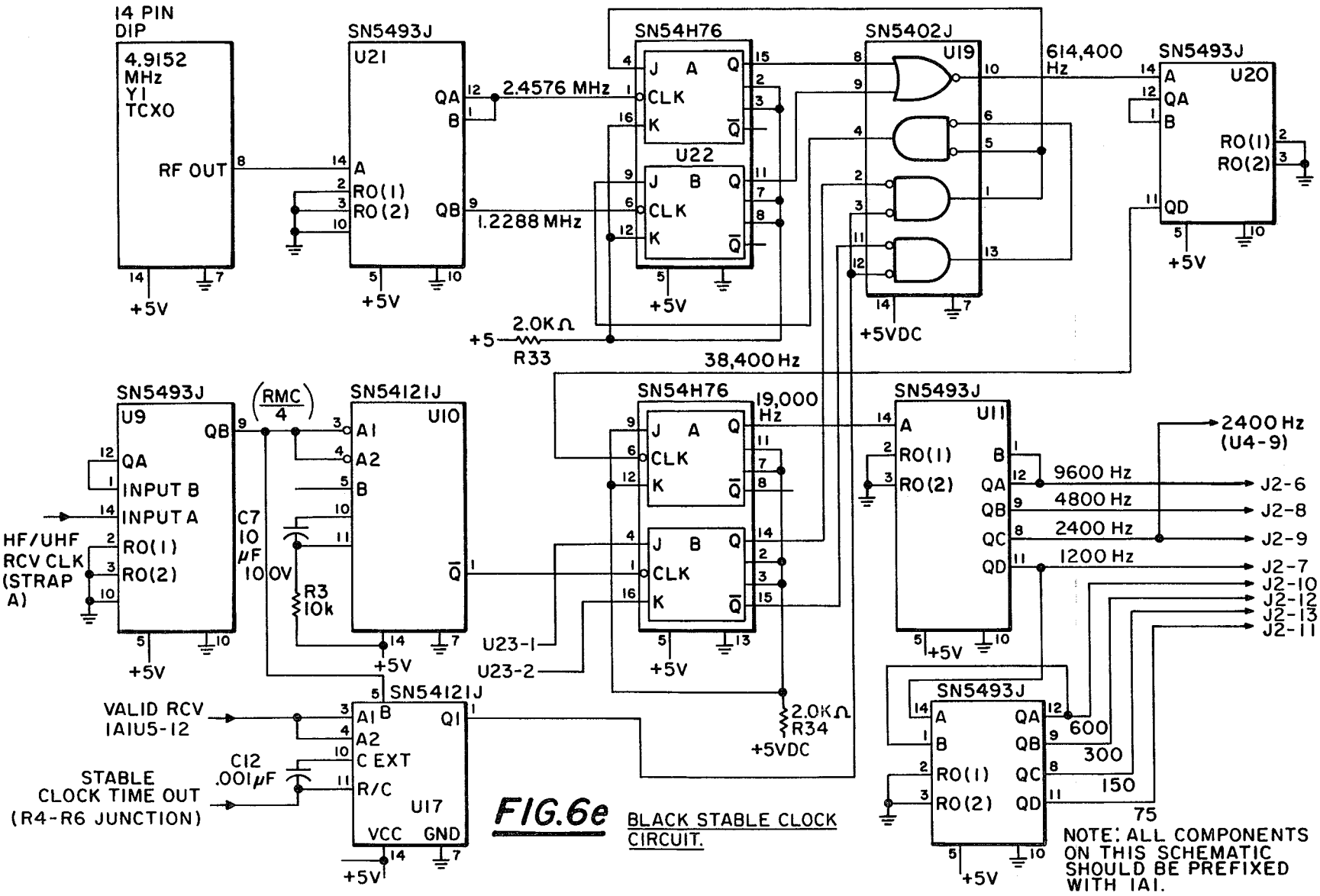
FIG.6e BLACK STABLE CLOCK CIRCUIT.

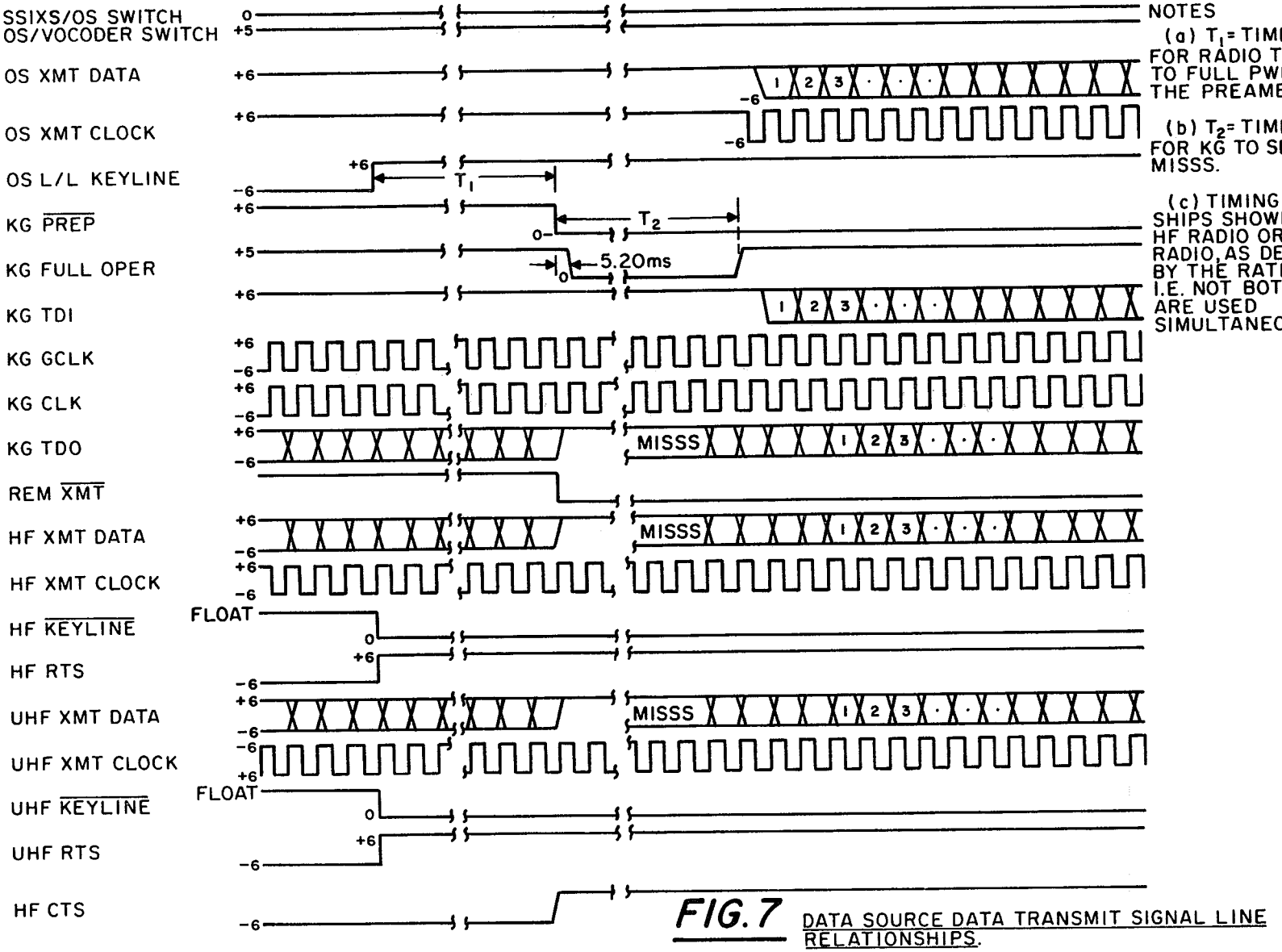
FIG. 7 DATA SOURCE DATA TRANSMIT SIGNAL LINE RELATIONSHIPS.

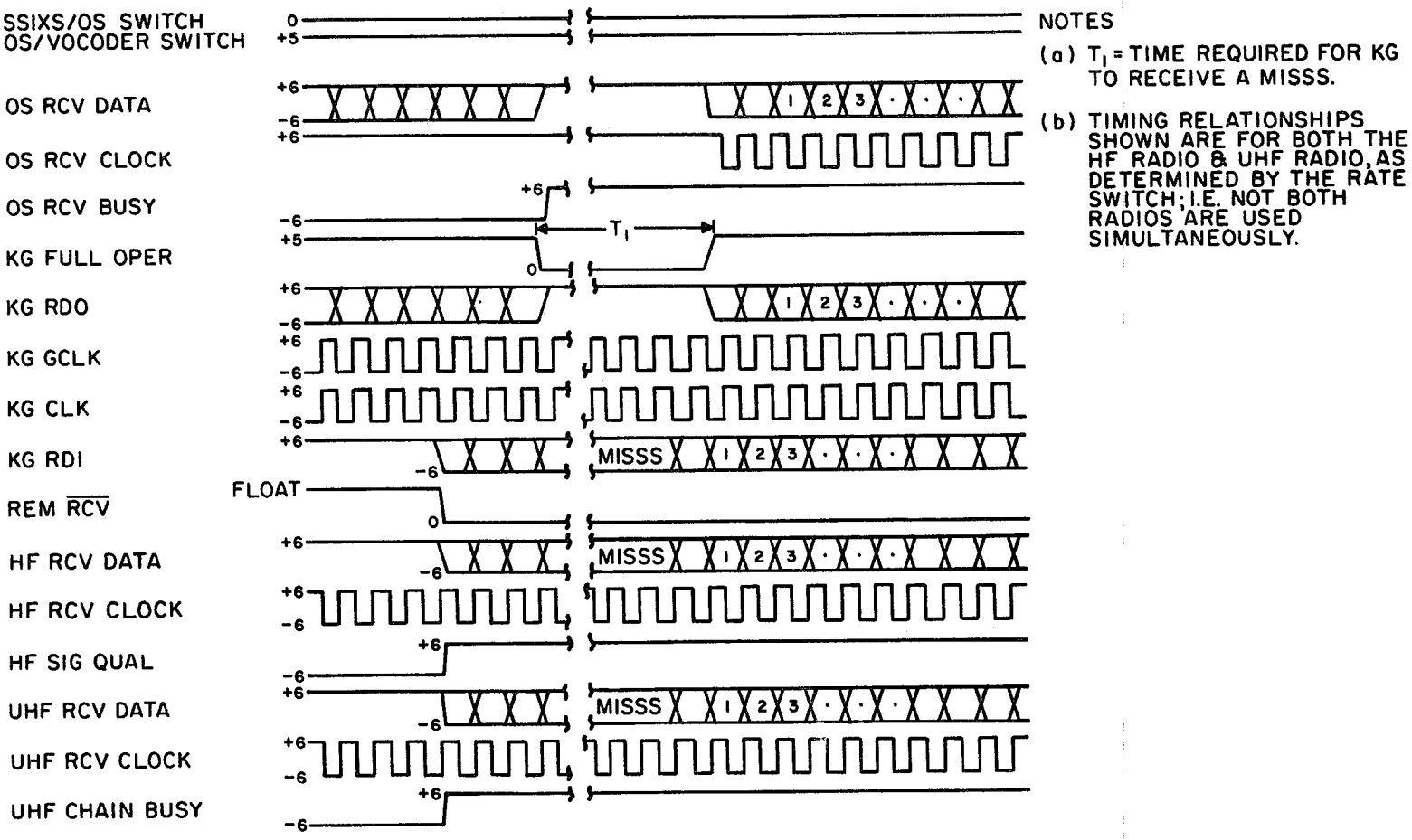
FIG. 8 DATA SOURCE DATA RECEIVE SIGNAL LINE RELATIONSHIPS.

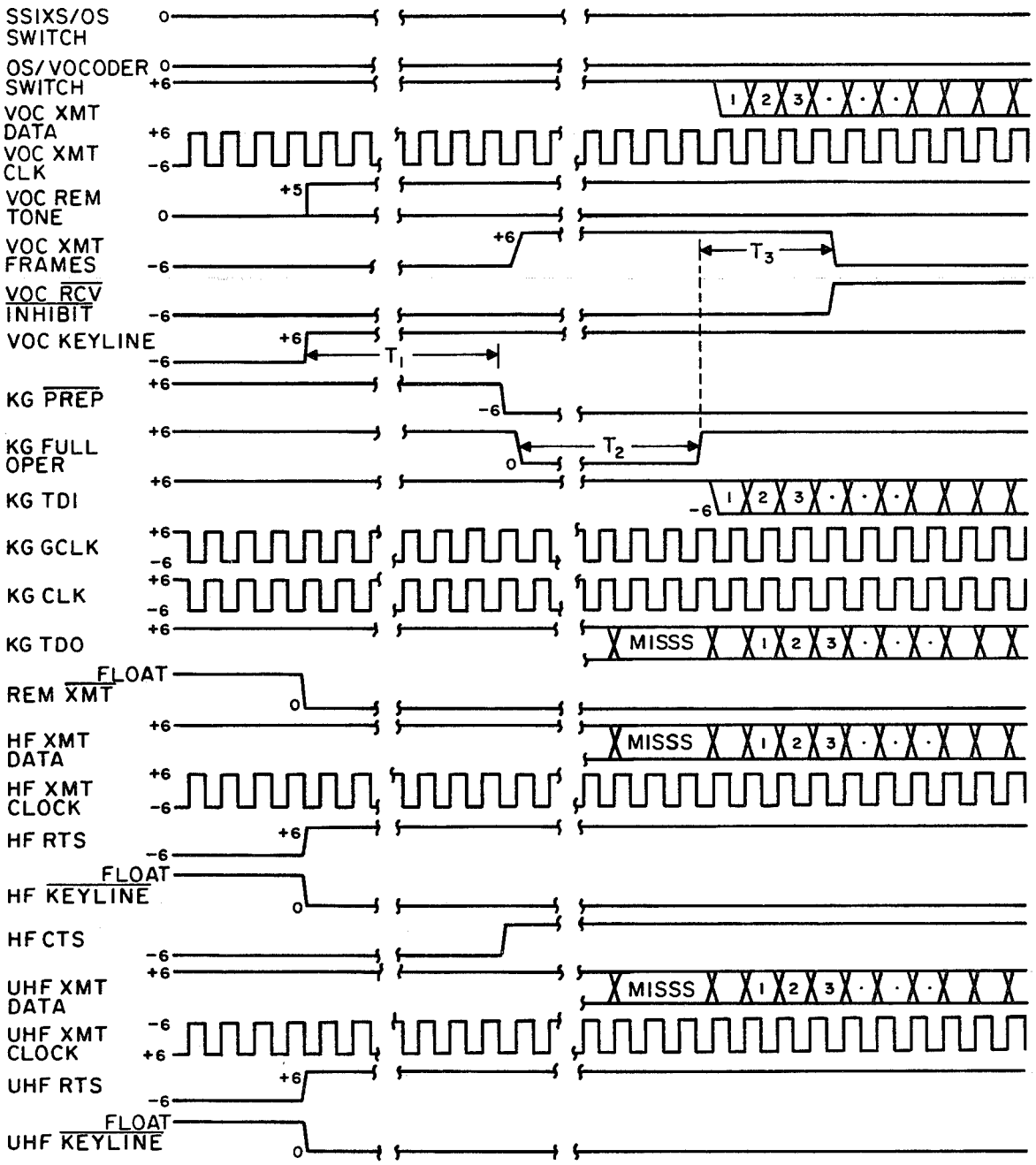

NOTES (a) $T_1$ = RADIO PWR UP TIME + PREAMBLE TIME.

(b) $T_2$ = TIME REQ'D FOR KG TO SET UP & XMT MISSS.

(c) $T_3$ = 200ms. OF VOCODER XMT FRAMES.

(d) TIMING RELATIONSHIPS SHOWN ARE FOR BOTH THE HF & UHF RADIO, AS DETERMINED BY THE RATE SWITCH; I.E. NOT BOTH RADIOS CAN BE USED SIMULTANEOUSLY. NOTE THAT THE HF RADIO CAN ONLY BE USED AT 2400 Hz WITH THE VOCODER.

FIG. 9 VOCODER TRANSMIT SIGNAL LINE RELATIONSHIPS.

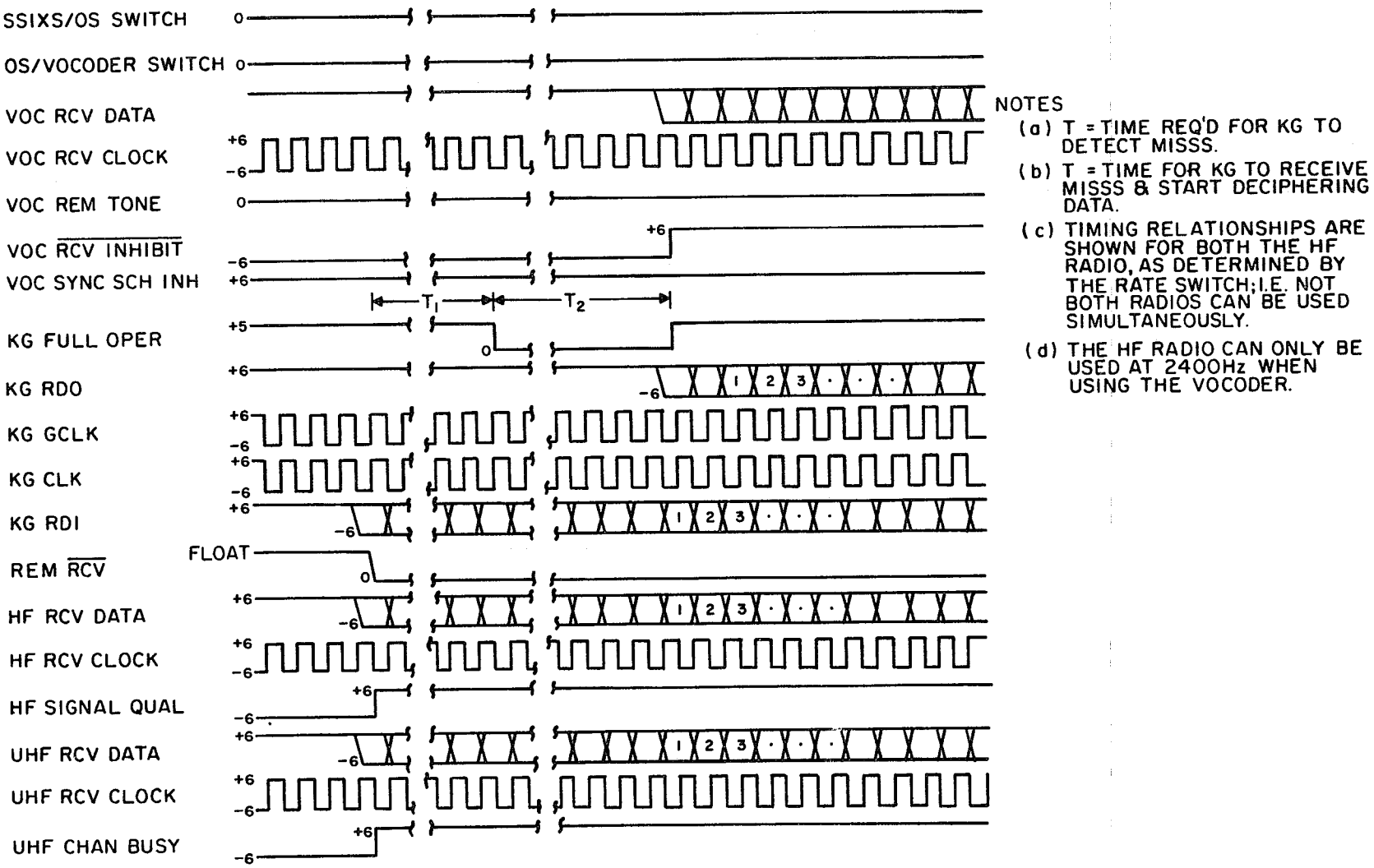
FIG. 10 VOCODER RECEIVE SIGNAL LINE RELATIONSHIPS.

DIGITAL INTERFACE SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

More reliable means of communications are being continuously developed. Radio waves particularly are susceptible to disruption due to natural and man-made interferences. Unfortunately lives may be lost when such interferences might impede disaster relief and national defense communications since timely information can reduce indecision or initiate responsive action.

Oftentimes sensitive information from a data source and from vocal utterances quickly must be encrypted, processed, transmitted and decrypted for use. This process calls for a separation of the data into categories generally referred to as red information or black information. Red information, generally speaking, is classified plain-text that usually is found on the unencrypted side of data transmission or processing equipment. Black information is encrypted information. Thus a red/black concept refers to the electrical and electronic circuits, components, equipments, systems and so forth which handle classified plain-text information in electric signal form (red) which is separated from those parts of a system which handle encrypted information (black). Under this concept, red and black terminology designates such circuits, components, equipment systems and so forth and the areas in which they are contained.

A variety of so-called secured communications systems have evolved which profess to be able to handle classified, encrypted and unclassified information and which may or may not use redundant links for reliability. The communication switching system by Christian Jenny of U.S. Patent and Trademark Office, U.S. Pat. No. 3,970,994 discloses a distribution control having a register for each communication line. A plurality of processor modules are provided with a loop structured arrangement of interconnected branches on which data blocks can be transferred from each line register to and from each processor module. Another related patent to Jean Charpentier of the U.S. Patent and Trademark Office, U.S. Pat. No. 3,964,056 discloses a system which directs orders to peripheral devices in a data processing system having plural central control units. The system provides alternative routes through one central control unit to a peripheral in the event that the other loses access to the peripheral. In both of these cases there is no attempt made to separate the red from black information and neither concerns itself with providing for satellite relay of uhf information in the event of failure of the conventional hf link.

Thus, there is a continuing need in the state-of-the-art for a digital interface having uhf and hf communication links and which assures a separation of red and black information and, optionally, the ability to transfer information from another source such as a submarine.

SUMMARY OF THE INVENTION

The present invention is directed to providing a system for interfacing unclassified information and classified information to and from a pair of discrete radio links. A means for generating and receiving classified technical data and a means for generating and receiving classified voice coded data are interconnected to an encrypting and decrypting means. Also electrically coupled to the encrypting and decrypting means, a first transmitting and receiving means and a second transmitting and receiving means transmit and receive information in the uhf spectrum from over satellite links, or, conventionally, in the hf spectrum, respectively. Appropriate connecting means and coupling means assure that the red side and black side of the encrypting and decrypting means are maintained separate and distinct from one another. A providing means and submarine-satellite communication connecting means enable a submarine-satellite information exchange over the uhf link.

The prime object of the invention is to provide an improved, more highly reliable communication system.

Yet another object of the invention is to provide a communication system employing a uhf satellite communication link and a conventional hf communication link.

A further object is to provide a communication system fabricated to assure a red/black separation of information.

Yet another object of the invention is to provide a communication system having the capability for handling voice coded data and tactical data and the transmission and reception thereof through uhf satellite links and hf conventional links.

Another object is to provide a highly reliable system for handling encrypted and unencrypted information.

These and other objects, advantages and novel features of the invention will become apparent from the following detailed description of the invention when considered in conjunction with the accompanying drawings.

BRIEF DESCRIPTION OF THE DRAWINGS

FIG. 7 illustrates the timing waveforms for the data unit transmit function.

FIG. 8 shows the timing waveforms for the data unit data receive function.

FIG. 9 illustrates the timing waveforms for the vocoder transmit function.

FIG. 10 depicts the timing waveforms for the vocoder receive function.

DESCRIPTION OF THE PREFERRED EMBODIMENT

Figure 1:
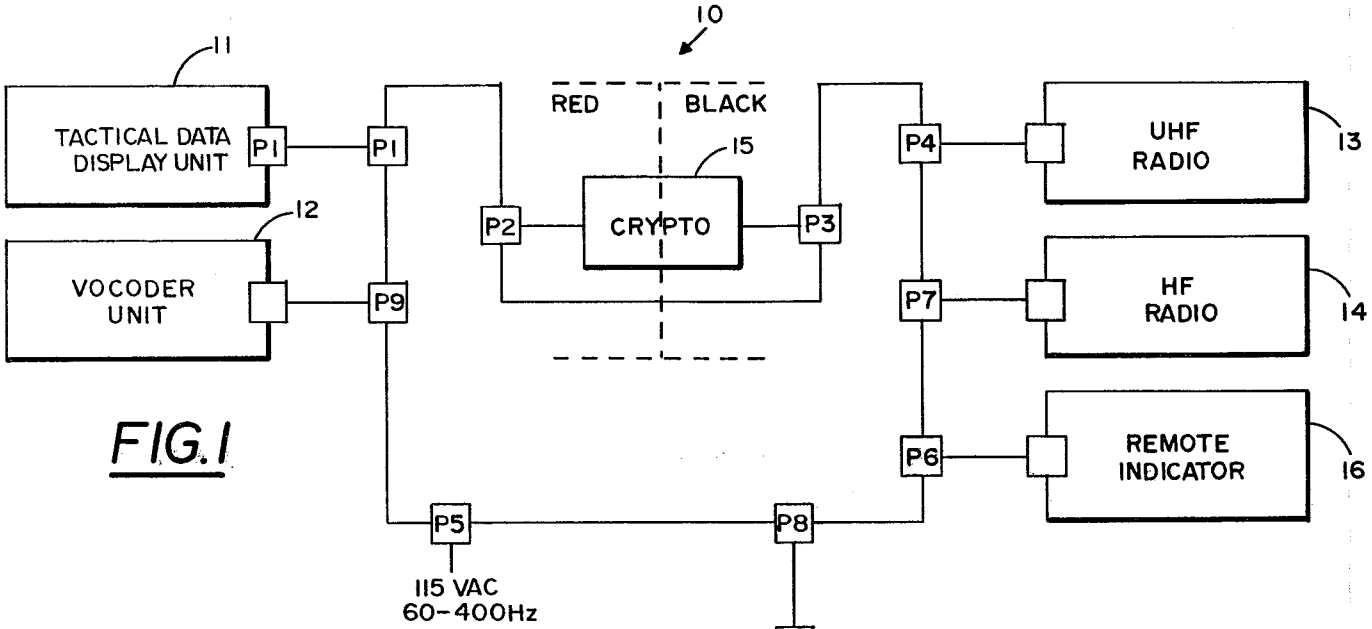
FIG. 1 illustrates the system as a block diagram.

Referring now to FIG. 1 of the drawings, the digital interface system 10 of the invention separates red equipments from black equipments. Those equipments are those which carry classified plain text information in electric signal form from those which handle encrypted or unclassified information, respectively.

A tactical data display unit 11 is interconnected into the system at P1 and a vocoder unit 12 is coupled into the system at P9. The digital outputs from the tactical data display unit and the vocoder unit are considered as being in the red equipments since they produce and receive plain text information which may be classified or unclassified in nature.

The tactical data display unit includes computers, memories, and display consoles for gathering, storing and showing digital information which has a particular relevance to a given tactical situation. The elements are conventional in design and largely include integrated components suitably coupled to handle data in a digital format. The sources for the information can include preprogrammed responses, solutions and visual read-outs which are generated when actuated by manual means or digital signals coming, for example, from remote sensors, monitoring stations and the like. The information and responses can be in memory.

The vocoder enables immediate vocal communications by planners, organizers or those in command, by generating digital words representative of the vocal utterances. The vocoder unit additionally has a corresponding function of reconstructing vocal words when appropriate digital signals are received by it. The vocoder is fabricated in accordance with well established designs that are in widespread use in the art.

The black side of the system includes the uhf radio frequency link unit 13 operatively associated with the system at P4 and the hf radio link unit 14 joined to the system through its coupler P7. The uhf unit permits communication with geostationary satellites for regional or worldwide distribution and gathering. Line modems (modulator-demodulators) that take digital signals and modulate them to audio tones and are capable of doing the reverse such as the MD 1061 marketed by Magnavox, Inc. are coupled to a transceiver such as a 960-SI manufactured by Collins Corp. work well as the uhf unit. Any of several commercially available transceivers might be substituted. Its function is to reliably transmit and receive digitized uhf information to and from the system via the satellite. Of course, proper antennas are used.

In like manner the transceiver of the hf radio link is one of many designs for assuring regional or worldwide communication in the high frequency band. Commercial models of like modems and transceivers such as those referred to with regard to the uhf transceiver above can be adapted by those skilled in the art to which this invention pertains to suitably interface with incoming and outgoing digitized data for responsive coupling to the tactical data display unit and the vocoder unit.

A crypto circuit 15 is part of the red and black equipments and is schematically depicted from the other electrically coupled units by its couplers P2 and P3. The unit can be a model made available to the Government of the United States such as a model TSEC/KG-36. On the red side it receives digitized data from the tactical data display unit and the vocoder unit and appropriately scrambles the information so that the true information content is hidden when it is transmitted over the uhf or hf links. In like manner, when similarly scrambled information is received by either the uhf or hf units and is fed to a black side of the crypto unit, it unscrambles it so that plain language information is fed to the tactical data display unit or the vocoder unit. A typical crypto unit is assembled from a multiplicity of, usually, integrated circuit elements to electronically encrypt or decrypt digital pulse trains. The exact constituency of one crypto unit as compared to another might be classified; however, all who are familiar with such units are well aware of a variety of encoding and decoding operations that can be routinely programmed to scramble and unscramble digital words. The details of the circuitry involved are not particularly germane to an appreciation of the inventive concept of this invention for it could be any one of many data processors commercially available except for the fact that its specific use might make such an application a classified one.

A remote indicator station 16 is to provide operators of the system with a visual indication when coupler P6 senses that the system is in use. The "in use" indication is not actuated when power is supplied to the system via connection P5, but rather when either the data unit or vocoder unit are transmitting or receiving information.

Figure 2:
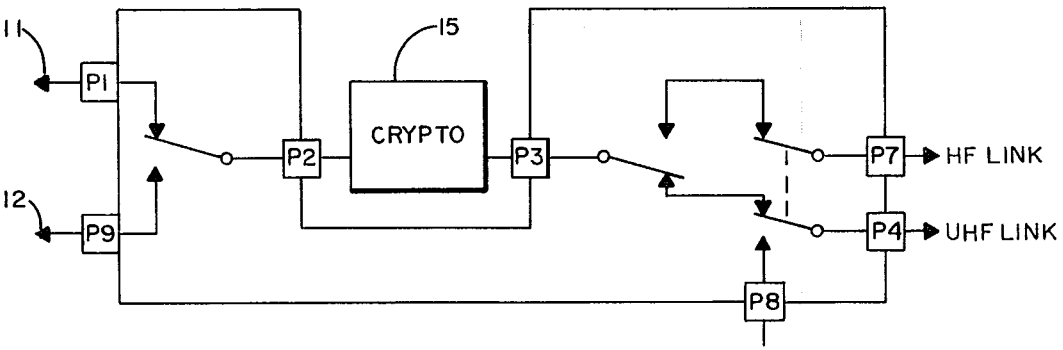
FIG. 2 depicts a switching diagram of the invention.
Figure 3A:
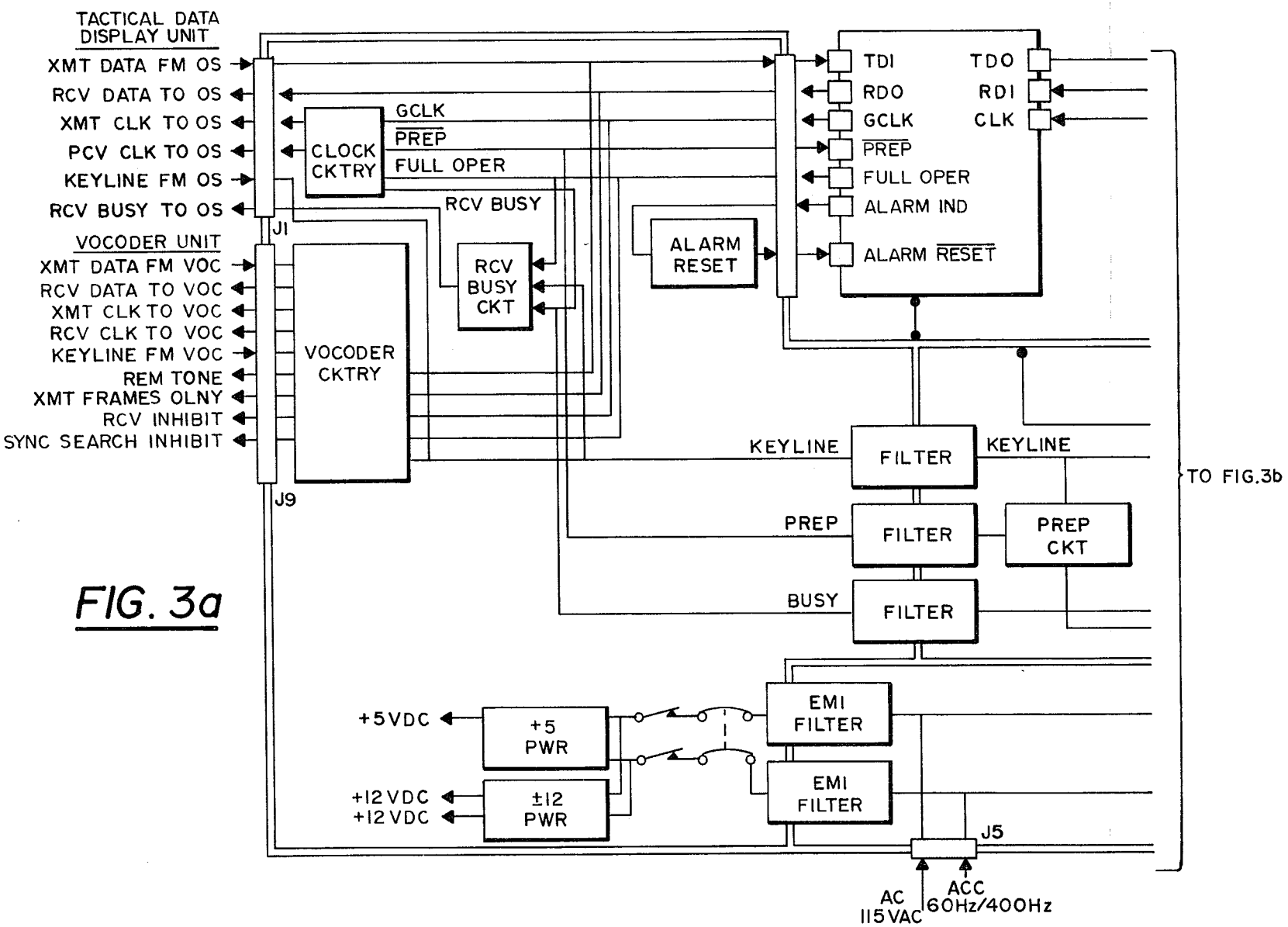
FIGS. 3*a, b* are the more detailed system block diagram of the invention.
Figure 3B:
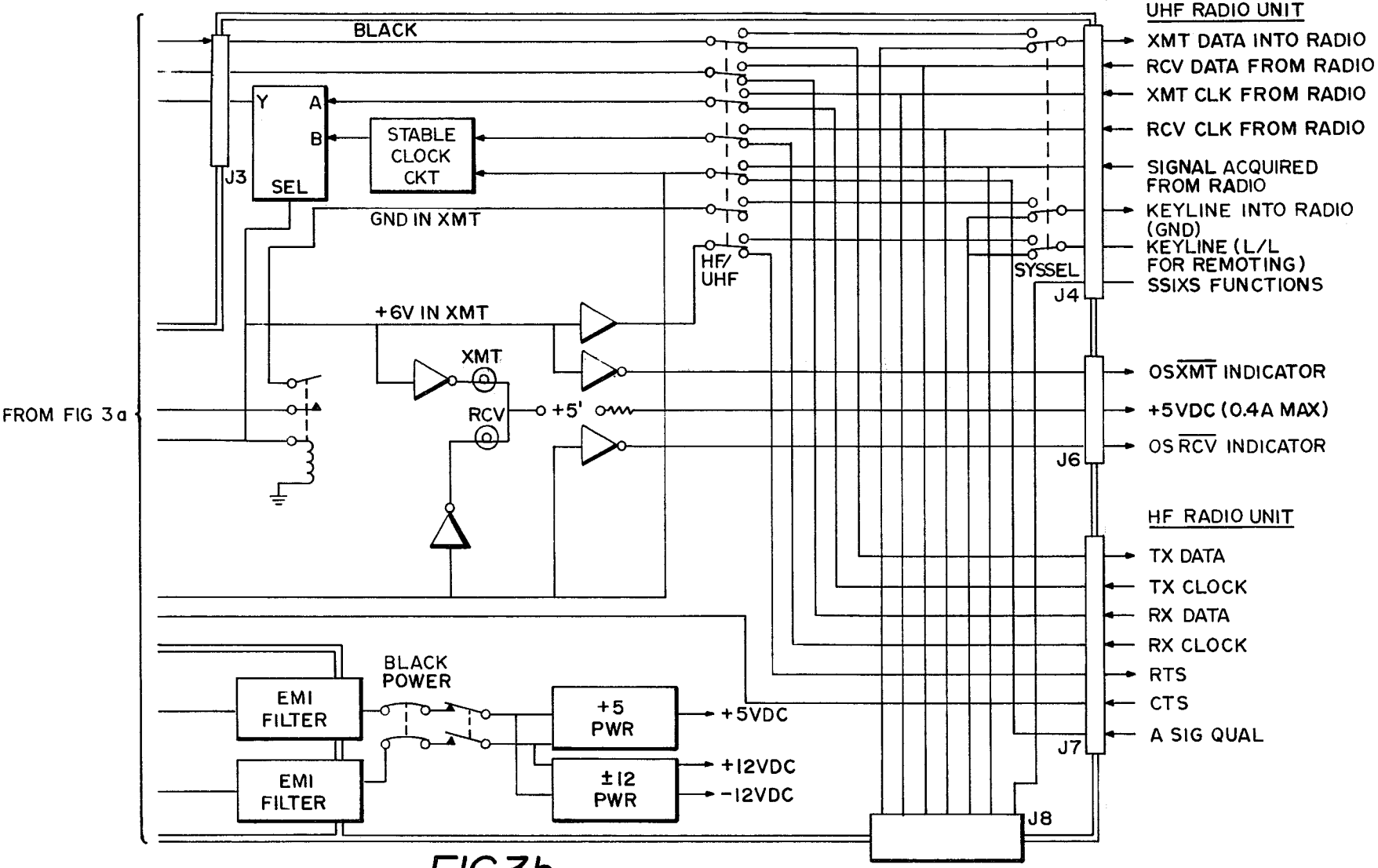

Referring to FIGS. 2 and 3, the switching function of the system serves to operably couple and uncouple the indicated units. The inherent functions of units P1, P2 and P9 are such as to either couple information out of or into the tactical data display unit only when the vocoder unit has been disconnected. Correspondingly, the vocoder unit is coupled to the crypto unit 15 only when the tactical display unit is electrically separated from the system. Either the tactical data display unit or the vocoder unit is coupled to the red side of the crypto unit to enable the encrypted information to be sent to the uhf radio link or the hf radio link. When either the uhf or hf link are operatively coupled to the inputs or outputs of the tactical data display unit or the vocoder unit via the crypto unit, remote indicator 16 provides a visual indication. When, however, the submarine-satellite information exchange system is actuated the hf link is disconnected through the coupler interaction of P8, P4 and P7 and the bi-directional exchange of information occurs only through the uhf link.

The system 10 performs to provide five functions which are, first to allow data unit 11 to transmit data over the uhf or hf radio; second, to allow the data unit to receive data over the uhf or hf radio; third, to allow vocoder unit 12 to transmit digitized voice over the hf or uhf radio; fourth, to allow the vocoder unit to receive data over the hf or uhf radio; and, fifth, to connect the uhf radio to the strategic submarine exchange unit. This latter mode of operation will not allow the data unit nor vocoder unit to transmit. This function can be better understood by looking to FIGS. 6–10 of the drawings.

Figure 4A:
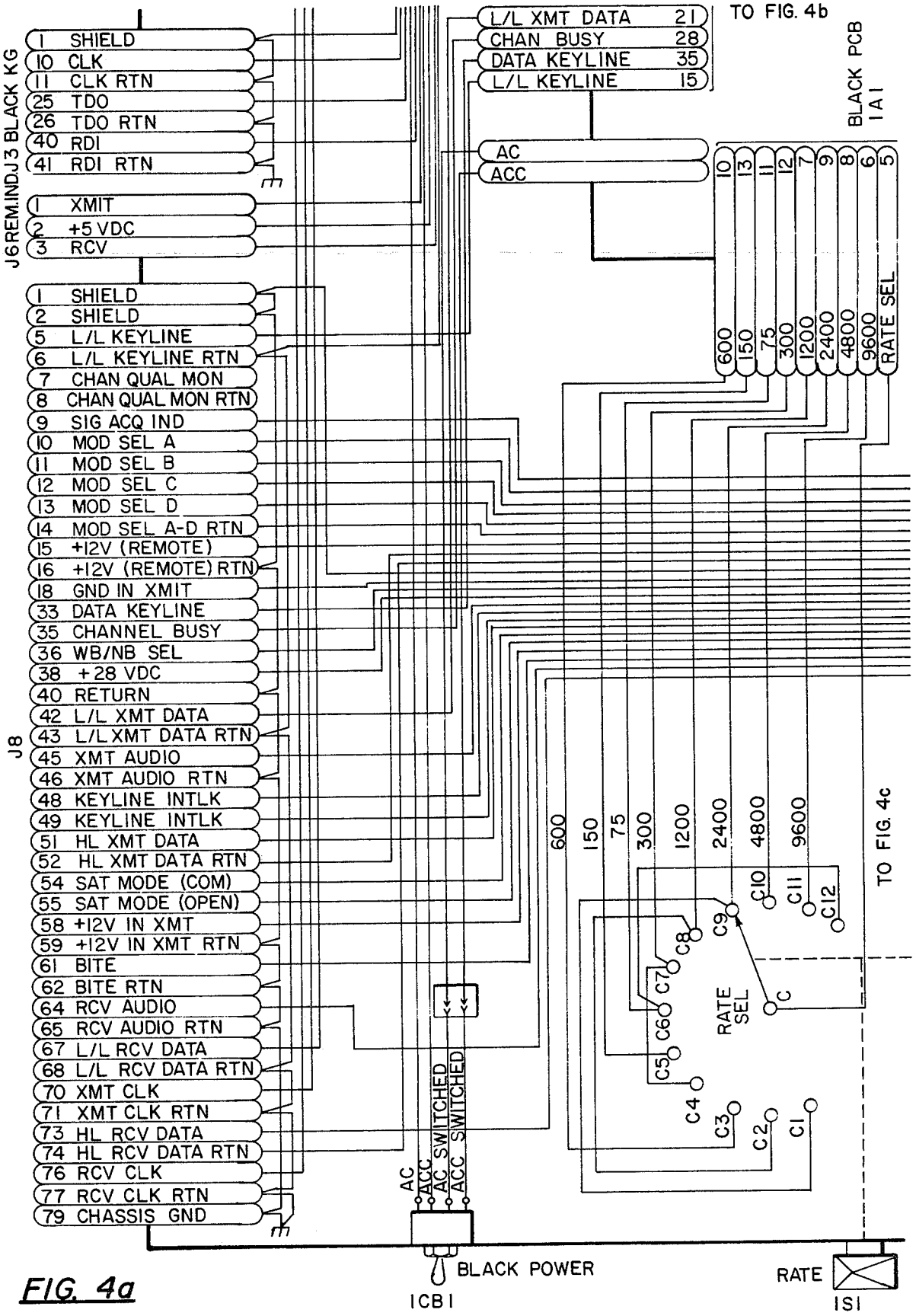
FIGS. 4*a, b* and *c* are the interconnecting wiring diagrams for the system.
Figure 4B:
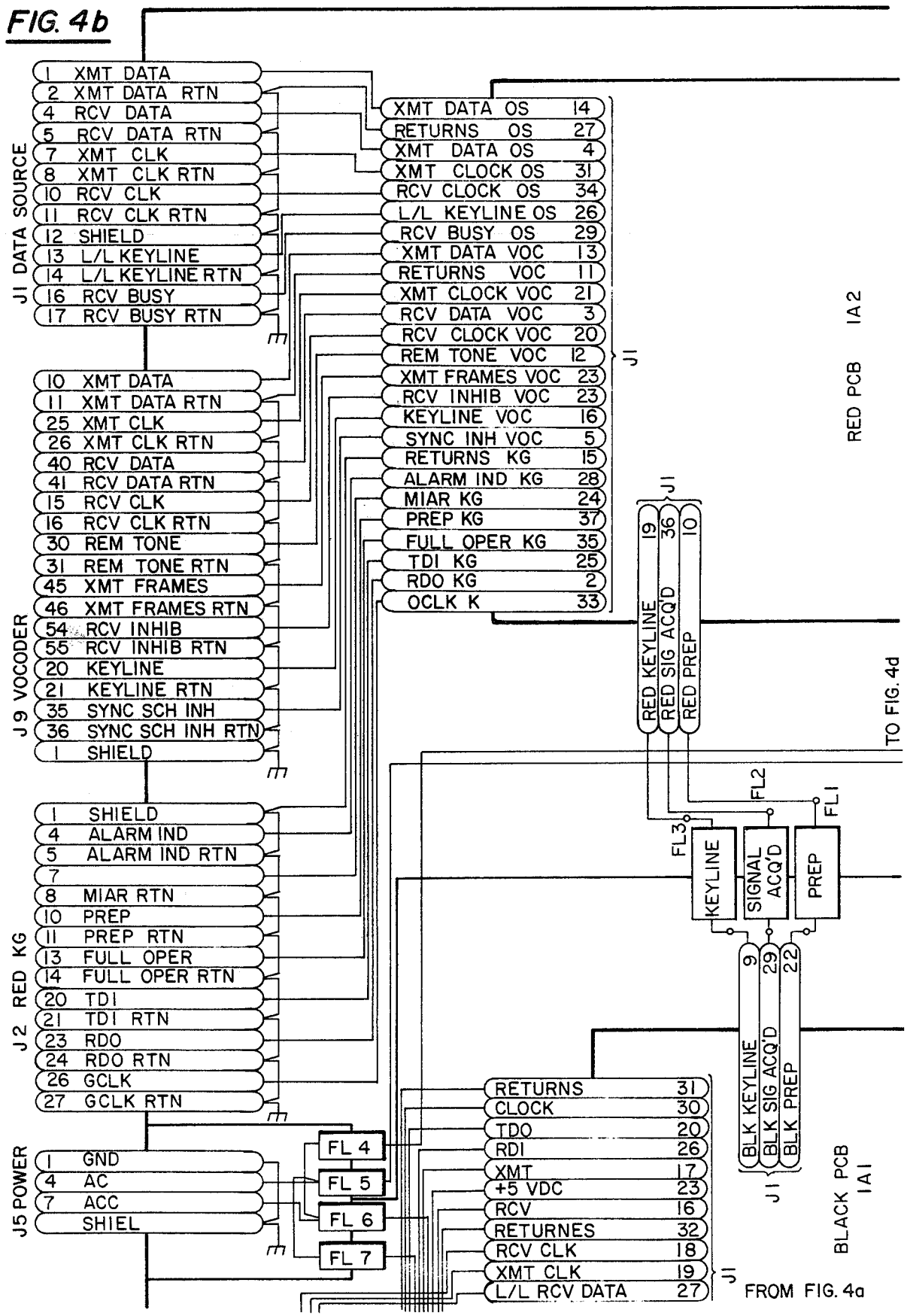
Figure 4C:
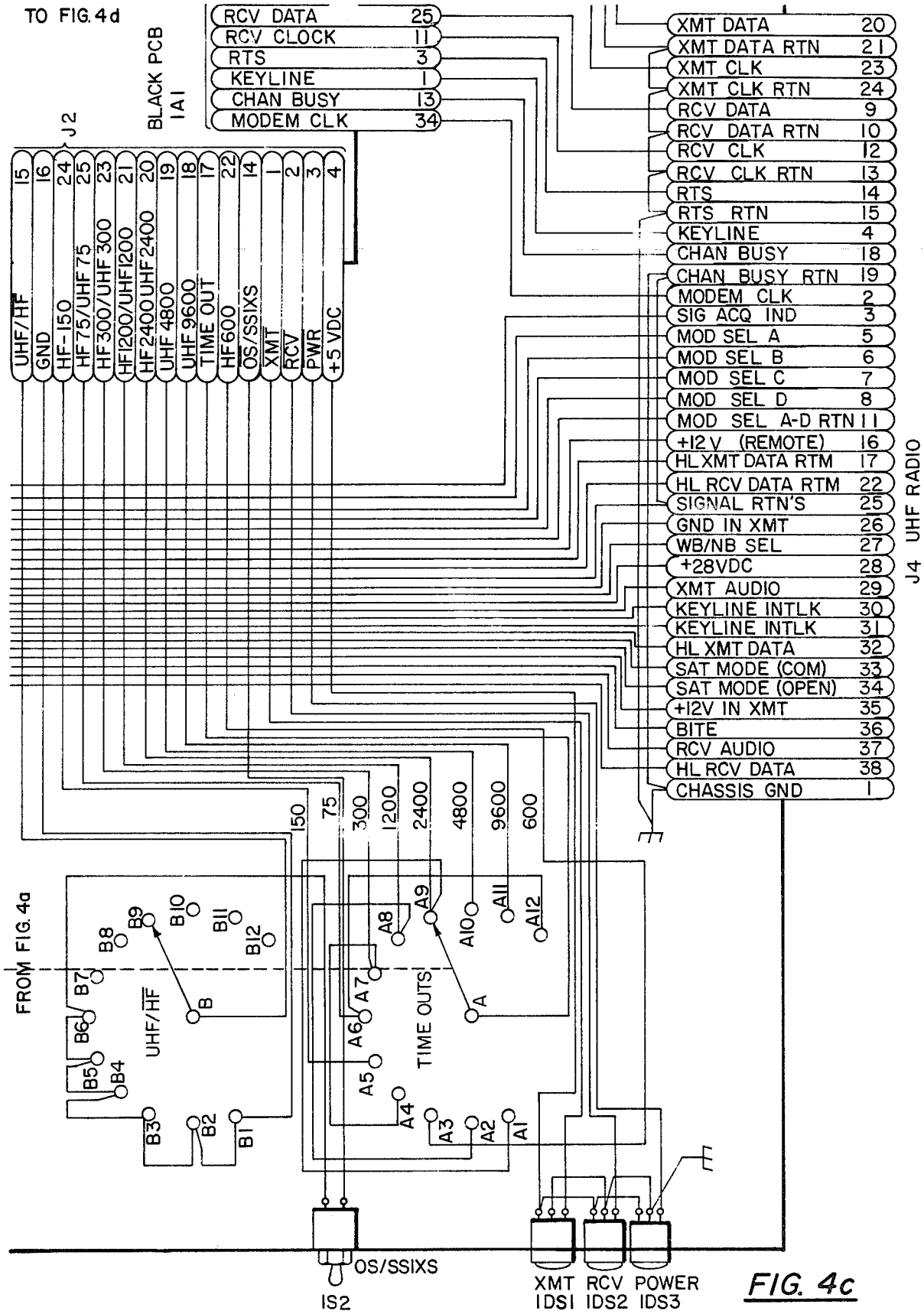
Figure 5A:
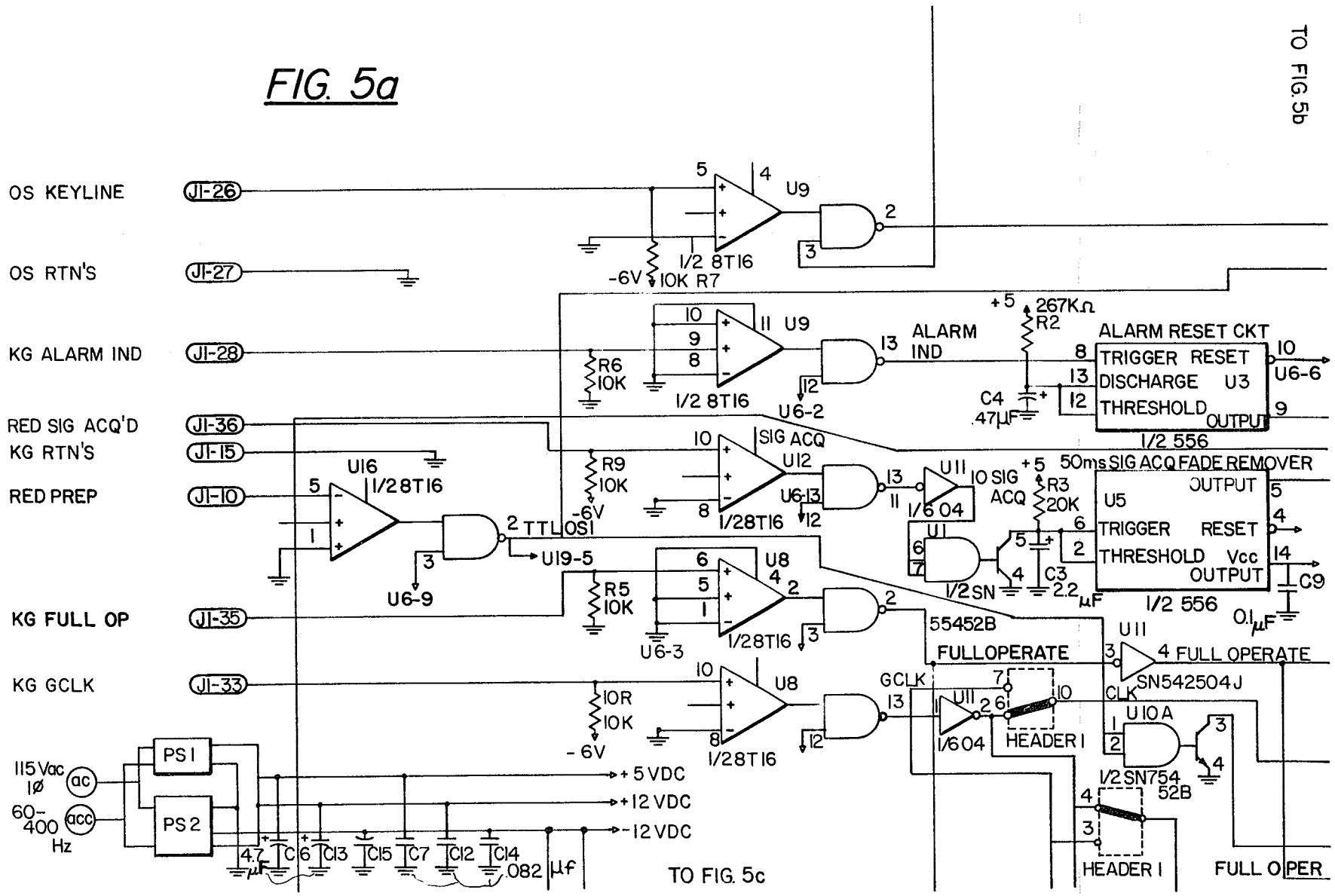
FIGS. 5*a, b, c, d,* and *e* are the system printed circuit board schematics.
Figure 5B:
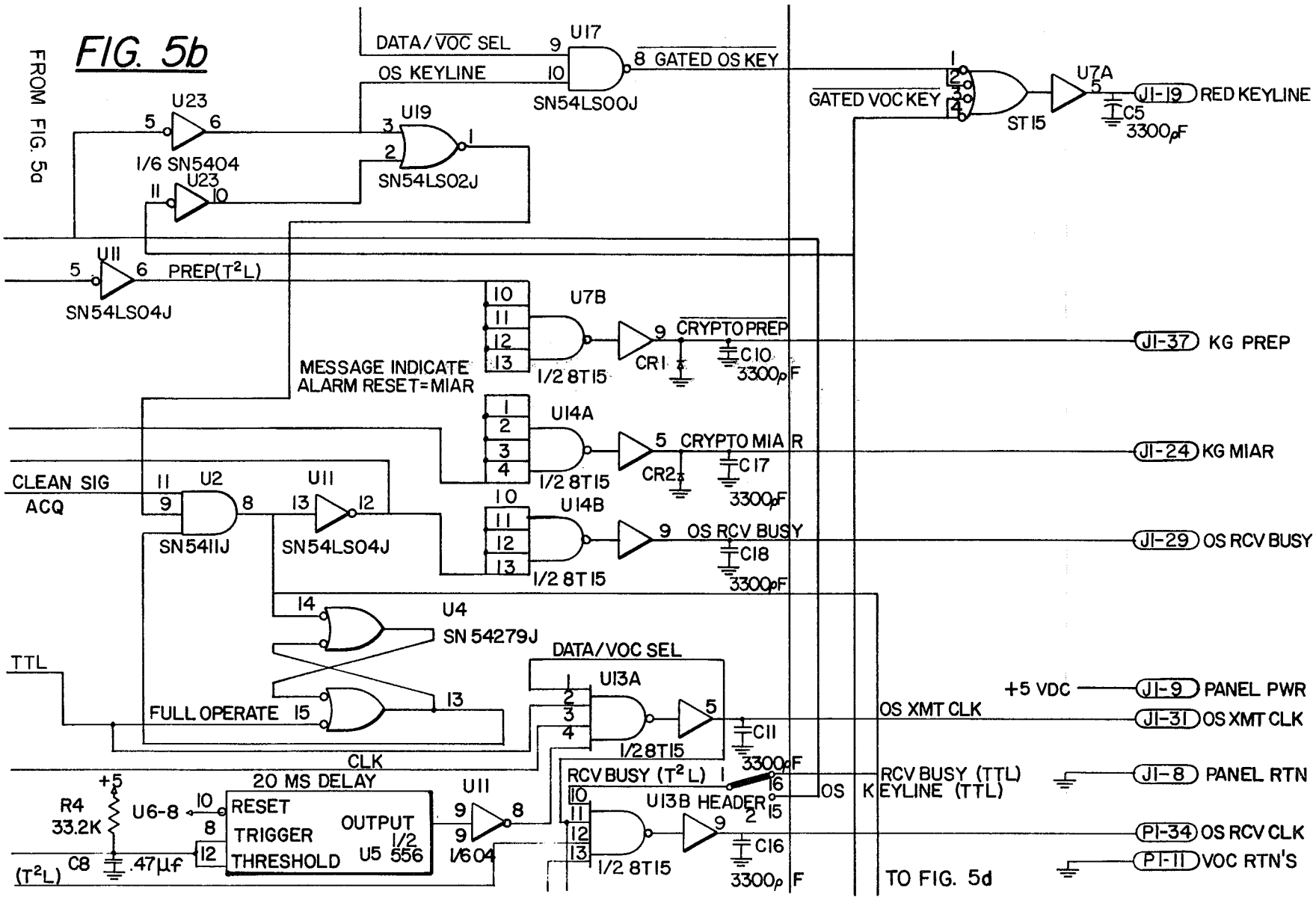
Figure 5C:
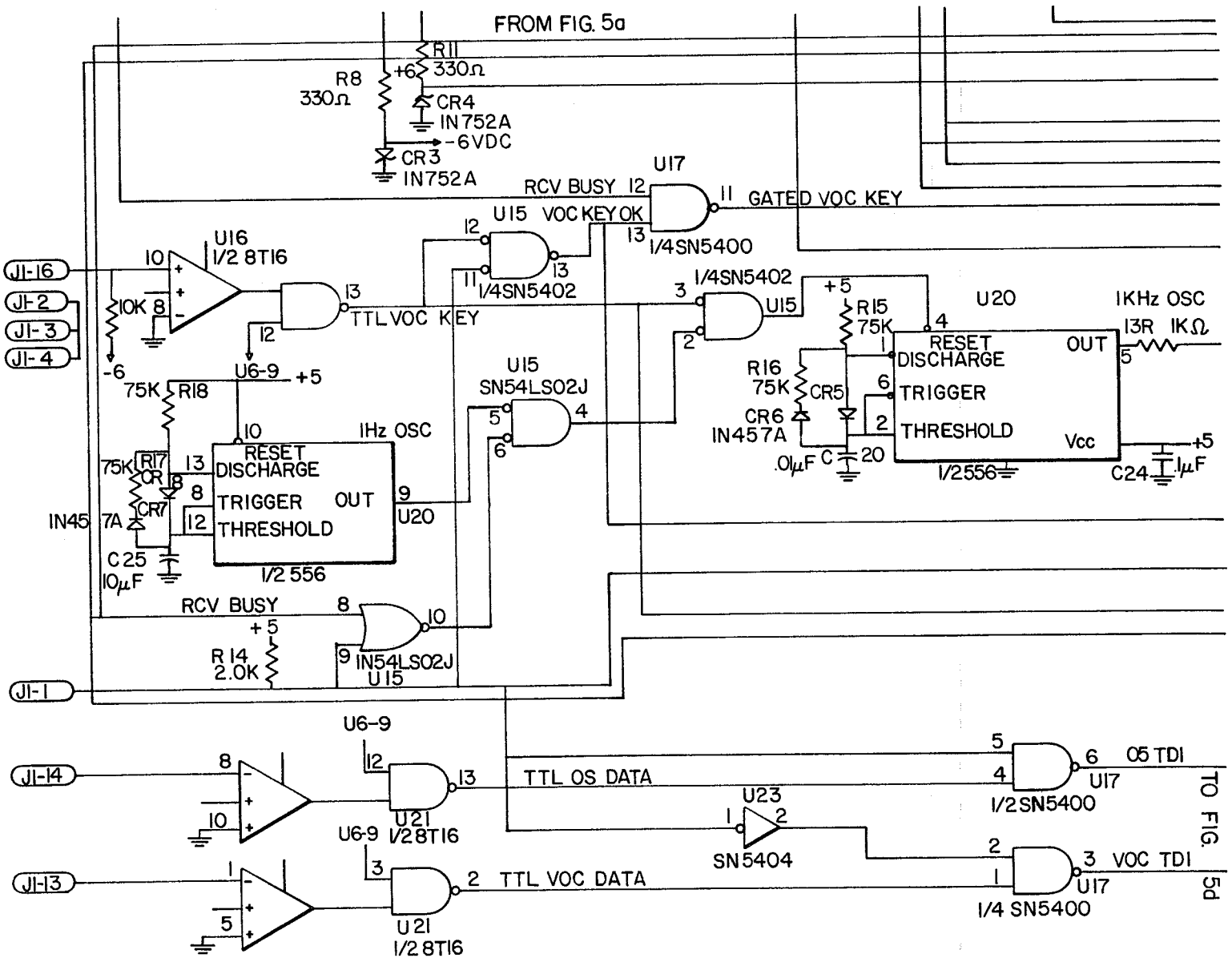

Transmitting from the data source 10 is as follows: the system red printed circuit board is known as unit 1A2, see FIG. 4*a,b,c* and *d*. The system black printed circuit board is known as unit 1A1. The data source KEYLINE arrives on 1A2 at J1-26 and is applied to U9-5. The U9 is a 8T16 188C receiver. The R7 will hold the system in a non-transmit state when no signal is applied on KEYLINE. When +6 volts is applied to U9-5, U9-2 will go to zero volts. This signal is applied to U23-5 and inverted at U23-6. The signal at U23-6 is a TTL OS KEYLINE and is applied to U17-10. If the system is in a data mode, U17-9 will be high and the output of U17 at pin 8 will go low when KEYLINE is high. When U17-8 is low, it will cause U7 pin 1 and 2 to go low and therefore U7-5 to go high. The U7-5 will be +6 volts when transmitting and −6 volts when not transmitting. A +6 volts is thus applied to J1-19 and goes across the red-black interface via the KEYLINE filter and arrives at the black printed circuit board. This KEYLINE signal on the black printed circuit board is known as black KEYLINE and arrives on board 1A1 at J1-9 and is applied to U16-10 which is a 188C receiver. The output of the 188C receiver is at U16-13 and is a negative logic signal. It will be zero volts when transmitting and +5 volts when not transmitting. The output of U16-13 is applied to U4-11 and U32-9. The U4 inverts KEYLINE/ into a positive KEYLINE at TTL levels. The U4-10 is the output and is applied to U12-5 and U12-9. The output at U12-6 and U12-8, drive transmit indicator at the data source remote indicator and the system front panel. The output of the U4-10 also enables U32-5, which allows transmit clock to be passed through U32 and appear at U32-6. The U32-6 is then applied to U13-11, 12, 13, which generates crypto clock at U13-9.

This crypto clock is used by the crypto on the black side to perform its transmit MISSS and eventually to clock out enciphered transmit encyphered data. The transmit clock which appears at U32-6 comes from one of two sources.

The clock signal will come either from the hf radio or from the uhf radio. This is performed as follows: if uhf transmit clock is used, it comes in on board 1A1 at J1-10 and is applied to U16-1, and if the U15-3 is enabled (it is enabled when uhf is selected) the clock will appear at U16-2 and be applied to U35-1, passed through U35, and appear at U35-3 which is connected to U5-3 and pin E of the header. A strap is then made from U32 pin 4 to either the inverted transmit clock or the noninverted clock. If the hf clock is utilized it is applied to board 1A1 at J1-14, is received by U8 and if U8 is enabled on U8-12 (which implies that the hf mode is selected), the hf transmit clock will appear at U8-13. If hf transmit clock is selected then U35-1 will be inactive, that is it will be at 5 volts, and and hf transmit clock appearing at U35-2 will become transmit clock at U35 pin 3 and passed to the crypto. Note, that the uhf transmit clock appears at header pin L and that hf transmit clock appears at header pin K, these are made available. The positive logic KEYLINE signal at U4-10 is also applied to the hf and uhf transmit KEYLINE circuitry at U24 pin 13 and U1 pin 7.

If the system mode is selected vice the submarine-satellite exchange mode, the system will be allowed to control transmitting at the selected uhf and hf radios. Observe that KEYLINE is applied to U24-13. OS should be selected on U24-12 and when KEYLINE is active, U24-11 goes to zero volts, inverted by U23 and applied to U26-9. If hf is selected, then U26 pin 10 will be low. If uhf is selected, then U26 pin 10 will be high, thus allowing output of U26-8 to go low when KEYLINE is active. This low turns on both the modem request to send and uhf KEYLINE/. When OS is keying and uhf is selected, the output of U26-8 will go low, a low at the input of U27 pin 2 and U36 pins 10 and 11 will cause modem request-a-send to go to +6 volts thus turning on a line modem if required; it also energizes relay K1, which will make J1-1 go to ground when KEYLINE is active. When KEYLINE is not active, K1 is released and pin J1-1 will float and modem request-a-send will go to −6 volts. If uhf is not selected, then J1-3 will be at −6 volts and J1-1 will float. The KEYLINE output from U23-8 is also applied to the U26-12. If U26-13 is at +5 volts, indicating that hf modem is selected, then the output of U26 at pin 11 will go low when KEYLINE is active. This low is applied to U27 and to U36, a low on the input of U36 will cause U36-5 to go to +6 volts when KEYLINE is active and go to −6 volts when KEYLINE is inactive. The U27 input at pins 6 and 7 being low will cause K2 to be energized and a ground to appear at J1-6, which implies a transmit and when the input to U27 is high then J1-6 will float. The KEYLINES being activated for the radios will cause the radios to start transmitting.

The radios will send out the preamble and a determined time later, the KG-36 will be prepd and a MISSS will be transmitted. That operaton will occur as follows: if uhf is selected then the system must select various timeouts according to the data rate selected and then generate prep. If hf is utilized, then after a determined length of time the hf modem is told to transmit, the hf modem will raise clear to send. Clear to send will cause prep to be generated at J1-22. The uhf prep will be generated as follows: the KEYLINE appears on U1 pin 7, a high at U1-7 and U1-6 will cause the transistor of U1 to be turned off and allow C-13 to charge at a rate determined by R17, R15, R13, R11, R8 or R5. The resistor in series with C13 is determined by the front panel rate switch on the system. After the proper uhf timeout has been reached, U28-2 and U28-6 will reach ½ VCC (determined by U28-5) and the normal high output of U28-3 will go to zero volts. Zero volts applied on U4-13 causes U4-12 to go high which is TTL PREP. The TTL PREP being +5 volts at U32-13 assuming U32-12 is selected, will cause U32-11 to go to zero volts thus causing U31 a 8T15 188C driver at pin 9 to go to +6 volts when prep is active and to go to −6 volts when prep is not active. The BLACK PREP appearing at 1A1 J1-22 is forwarded to the red printed circuit board through the PREP filter across the red/black interface. Once BLACK PREP passes through the filter it becomes RED PREP. It appears at 1A2 J1-10 and is applied to the 188C receiver U16 at pin 5. The U16-2 is the inverted TTL PREP signal, it is again inverted by U11 and applied to the 188C driver U7. The output of U7-8 will attempt to go to −6 volts during TTL PREP being +5 volts but is clipped at zero volts by CR1. Thus at J1-37 a negative logic prep signal will appear.

When the data source is transmitting, the radio KEYLINE immediately is activated, a certain time later, the KG PREP/ is activated. The crypto will then transmit a MISSS to the receiving crypto. Upon completion of the crypto transmitting, a MISSS the crypto will raise KG FULL OPERATE appearing at J1-35 of board 1A2. The signal KG FULL OPERATE at J1-35 is applied to U8-6, it is inverted to become FULL OPERATE/ at U8-2. FULL OPERATE/ is inverted for a positive logic FULL OPERATE U11-4. This is applied to U13-12 which is the 188C driver that allows transmit clock to be forwarded to the data source and thus allowing the USQ-81 to clock transmit data out of its system. Full operate also appears at U13-2 and if the data mode is selected, U13-1 will be high and if clock is being received from the crypto at U13-3 and prep is high at U13-4, then transmit clock will appear at J1-31. The KG gated clock appearing at J1-33 is applied to U8-10, inverted output is at U8-13 and header pin 10 can be strapped to either pin 7 or pin 6 for the desired clock phase. Clock from the crypto is thus presented to U13 pin 3. The 20-millisecond delay circuitry in series with U13-4 is required to prevent a short burst of transmit clock being generated to the data source during the first part of a transmit sequence. This occurs when RED PREP first goes high and FULL OPERATE is also high (being high left over from a receive sequence) prior to full operate dropping when the KG-36 is prepd. The requirement for this 20-milisecond delay exists because after the KG-36 is told to prep, it will not be able to drop full operate due to the heavy filtering of the KG-36.

The FULL OPERATE does not drop at the system for up to 15-miliseconds after KG PREP/ is received by the KG-36. The U5, 20-milisecond delay circuitry will overcome this full operate fall delay. Its operation takes place as follows: RED PREP is seen to go active at U16 pin 2 by going to zero volts. The Zero volts on U10 pin 1 and 2 will cause the transistor in U10 to turn off and allow C8 to charge. When the trigger of U5 reaches $\frac{2}{3}$ VCC, the normal high output of U5-9 will go low causing U11 pin 8 to go high and thus allowing transmit clock to occur 20-miliseconds after prep goes active. However, by this time full operate at the KG-36 has gone low, thereby U13 pin 2 is sitting at zero volts which inhibits transmit clock at U13 pin 5. When FULL OPERATE from the KG-36 finally does go to a logic 1 (i.e., +5 volts at U13 pin 2) and clock is available at U13 pin 3 and U5 has exceeded the 20-milisecond delay period, U13 pin 4 is enabled and data is selected on U13-1, all necessary conditions exist for TRANSMIT CLOCK to be generated at U13 pin 5 and to be forwarded to 1A2 J1-31, thereby generating transmit clock to the system. The AN/USQ-81 transmit data comes on to 1A2 at J1-14 and is converted to TTL levels by U21. The U21-13 is a true TTL TRANSMIT DATA signal and is applied to U17 pin 4 and if the data mode is selected U-17 pin 5 will be at 5 volts, thus allowing transmit data to be present at U17 pin 6 and applied to U18 pins 1 and 2 as inverted data. The U18 pin 5 has 188C data generated to 1A2 J1-25 which goes to the KG-36 TDI data in U17 pin 5. This signal will be at 5 volts when the data mode is selected and will be a zero volts (which will inhibit data appearing at U17-6) when vocoder is selected.

One additional transmit function exists in the system transmit mode and that is the case where the KG alarm will go high. The CRYPTO ALARM INDICATE signal arrives at 1A2 at J1-28 and is applied to the 188C receiver U9-9. It is converted into TTL logic at U9 pin 13 and is a negative logic signal. It is applied to the U3 pin 8 which will cause an alarm reset at U3 pin 9 which will last for approximately 200-miliseconds. This MESSAGE INDICATE ALARM RESET generated at U3 pin 9 is inverted by the 188C driver U14-5 to become MESSAGE INDICATE ALARM RESET/. The U14 pin 5 will attempt to go to −6 volts but is clipped at zero volts by CR2 causing MIAR/ to go to zero volts when an alarm on J1-28 goes to +5 volts. MIAR/ will remain low for approximately 200-miliseconds at which time it will return to +6 volts. After the KG-36 encyphers its TDI, the KG-36 will generate encyphered TDO to the USDIU. The TDI will enter the OSDIU board 1A1 at J1-20. The KG-TDO is then received by U29, and the noninverted TTL OS DATA will appear at U29-13 and be applied to U24 pin 10. If OS is selected, U24-9 will be at 5 volts and the output at U24-8 will be inverted TTL TDO. This inverted TDO will be inverted again in the true signal at 188C levels by U25. The U25-5 is the ±6 volt signal being generated to 1A1 J1-4 and forwarded to the uhf transmitter to be transmitted. The U24 pin 9 will be high allowing the TDO data through U24 if the OSDIU has OS selected.

A submarine satellite communication system interfaces with a submarine satellite information exchange subsystem (SS1×5) like that disclosed in the July 1980 U.S. Navy publication by Naval Electronics Systems Command PME-106 entitled "Navy UHF Satellite Communication System Description". If submarine-satellite exchange is selected, then U24-9 will be zero volts, no data will get through U24 pin 8 and instead the data received from the submarine-satellite exchange on 1A1 J1-21 will be received by U29, forwarded to U24-4, passing through U24 to pin 6 and to U25 pin 3 and 4 and then out the uhf transmitter as 188C data on J1-4. It should be noted, that the KG TDO will be allowed to pass through U29 only if U29-12 is at +5 volts, which will occur only if U26-6 is at +5 volts and that requires either U26-5 or U26-4 to be at zero volts which is caused when there is a BLACK PREP present from the hf or uhf transmit sequence. Note that hf transmit data being applied to the hf data modem at 1A1 J1-5 will always be sourced by KG TDO. This is because the input of U25 is tied directly to the output of U24 which is TDO whenever prep is active.

If the submarine-satellite exchange is selected on the front panel of the system, then 1A1 J2-14 is a positive 5 volts and will enable U24-5 while inhibiting U24-9. Data will then be passed from U24-6 to U25-3, 4 and out to the uhf transmit data via 1A1 J14. If 1A1 J2-14 is at +5 volts as indicated by the OSDIU front panel SSIXS/OS/ switch being set to SSIXS, then the input of the U37-6 will be +5 volts. This automatically causes U37-1 pin to be at +5 volts selecting uhf. If OS is selected on the OSDIU front panel then U37-6 will be low. The front panel uhf/hf rate switch is selected to uhf then U37-5 will be high causing U37-4 to be low, (i.e., now to be in the hf mode) this causes a low on U37-2 and U37-3 that will cause U37-1 to be at +5 volts, which indicates that the OSDIU is in the uhf mode. If uhf/hf data rate switch is in hf, then J2-15 will be at zero volts and this zero volts being applied to U37-5 along with zero volts on U37-6 will cause U37-4 to be at 5 volts and provides the hf mode to be selected and the uhf mode to be not selected.

The hf selection or the uhf selection, controls uhf TRANSMIT CLOCK on U16, uhf RECEIVE CLOCK on U15, uhf CHANNEL BUSY on U15, SIGNAL QUALITY of U34, hf RECEIVE CLOCK on U8, hf TRANSMIT CLOCK on U8, hf TRANSMIT CLOCK on U8, hf RECEIVE DATA on U33, and uhf RECEIVE DATA on U33.

Receiving at the data source 11 is as follows: looking to the drawings the red printed circuit board is 1A2 and the black printed circuit board is 1A1. Receive is initiated when the uhf radio or the hf radio receives and locks onto a receive signal. The uhf radio will then raise CHANNEL BUSY, which comes in on 1A1 J1-13 and the hf radio will raise hf SIGNAL QUALITY A on 1A1 J1-8 or will raise hf SIGNAL QUALITY B on 1A1 J1-36. The 1A1 S1-C3 can select either hf quality A or hf signal quality B. The selected signal quality will then be received by U34 and inverted to the negative TTL logic levels at U34-2. This will occur if hf is selected, enabling U34 gate at U34-3. If the uhf is selected then the output of U34 pin 2 will be disabled and will be +5 volts which will have no effect upon the operation of U35 pin 6. If uhf is selected, then the uhf CHANNEL BUSY arrives at 1A1 J1-13 and received by U15. This will produce a TTL negative logic CHANNEL BUSY/ at U15-2 if U15-3 is at +5 volts as indicated by uhf being selected. If either input of U35 at pin 4 or pin 5 goes low, then the output of U35 at pin 6 goes high. It is inverted at U5 pin 13 to become a VALID RECEIVE/ at U5-12. The output of U5-12 is used on U17-3 to enable a correction pulse to occur at U17 pin 1.

Figure 6A:
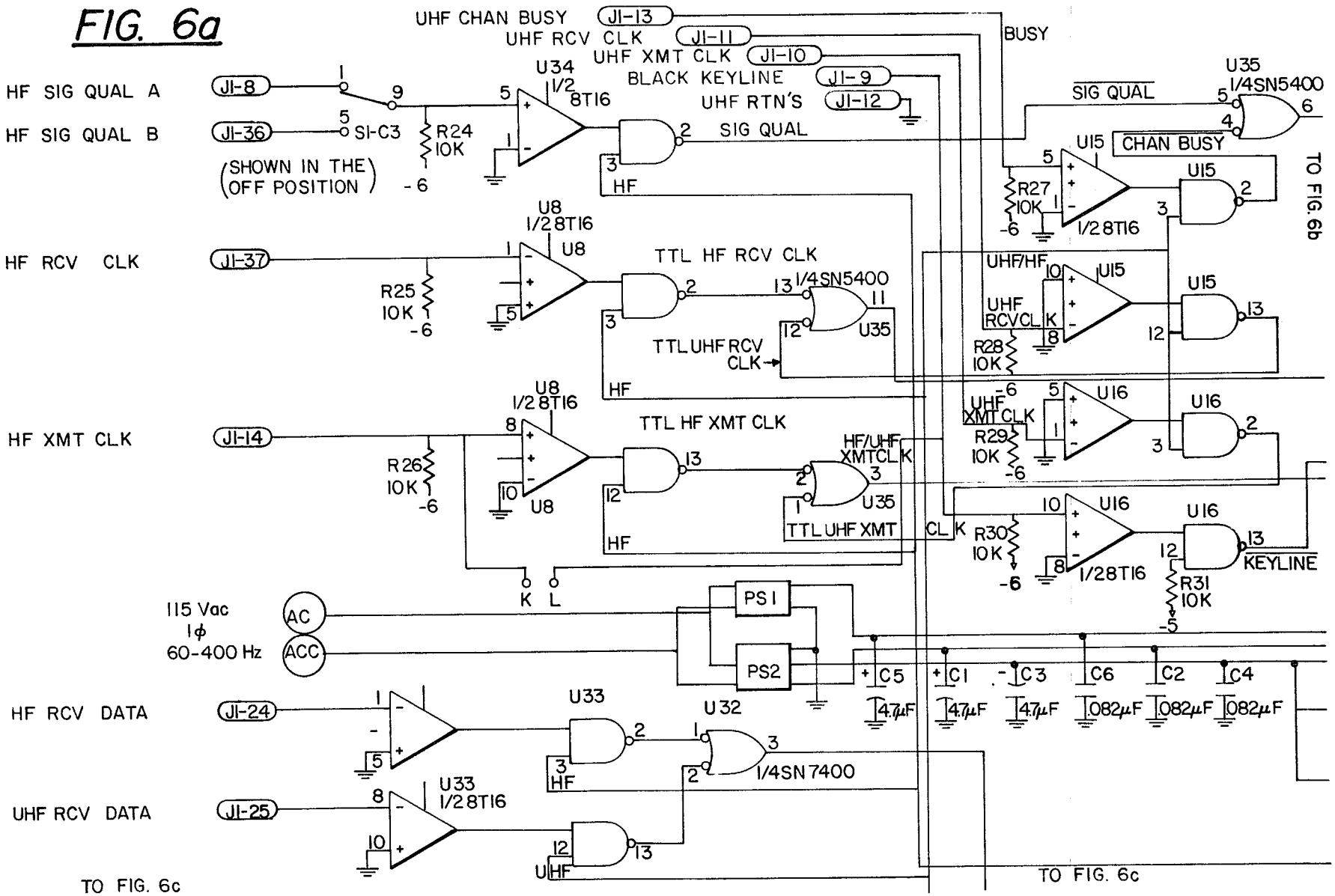
FIGS. 6*a, b, c* and *d* are printed circuit board schematics for the system.
Figure 6C:
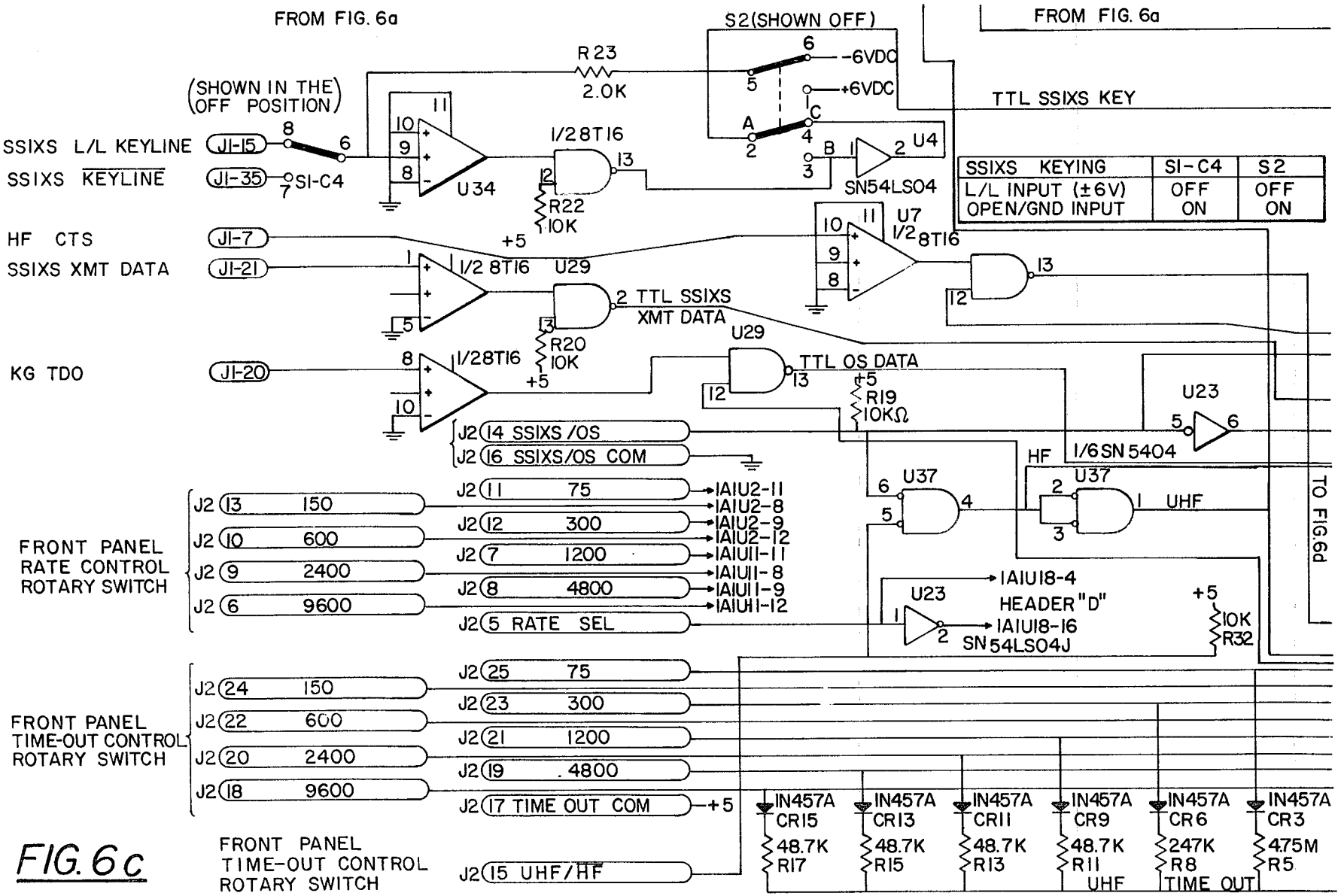

The circuitry of the second sheet of FIG. 6*d* is a stable clock circuit. The circuit explanation will be covered later.

The output of U35-6 is applied to U12-13 and U12-1 causing lamp drivers to go low which will turn on the receive lamp on the front panel of the OSDIU and the receive lamp at the remote indicator panel of the AN-/USQ-81. The output of U5-12 is applied to the input of the U-14 pins 10, 11, 12, 13 and will cause U-14 to drive SSXIS channel busy to a plus 6 volts when a valid receive is occurring and to go to −6 volts when no uhf receive signal is present. The U5-12 is also tied to the input of U4 on pin 1, 2, 3, and 4 which will cause the output of the 188C driver at U14-5 to go to +6 volts when a signal is being received from the uhf or hf radio. This output goes to the J1-29 and will go to the red printed circuit board by way of a filter. On the red side of the system, the BLACK SIGNAL ACQUIRED becomes RED SIGNAL ACQUIRED and is applied to 1A2 at J1-36. The RED SIGNAL ACQUIRE is received at U12-10 and generates a negative logic TTL SIGN ACQ/ signal at U12-13. Occasionally there exists brief periods of time when CHANNEL BUSY or SIGNAL QUALITY may possibly drop out for 10–40-miliseconds. It is desired to remove any of these fades. The purpose of U5 and its associated circuitry is to integrate SIGNAL ACQUIRED over a period of approximately 50-miliseconds. This is performed by U1 and U5.

The signal fade remover operates as follows: if signal acquired is logically high, that is +6 volts on U12-10, then signal acquired at U12-13 will be at zero volts, this is inverted at U11-10 and applied to U1 pins 6 and 7. When U1 pins 6 and 7 are at logical 1 (which is +5 volts) the transistor of U1 will be saturated and will short out the timing capacitor at C3 thus triggering U5 output at pin 5 to go high, if the signal fades briefly and goes to −6 volts at U12-10 then U11-10 will momentarily go to zero volts thus removing forward biasing on the base of the transistor in U1 and allowing C3 to start charging to VCC thru R3. It takes a period of time for the threshold to reach ⅔ VCC and during this time U5-5 remains high. If the signal fade is actually a loss of the receive carrier, then after 20-miliseconds, U5-5 will go low and remain low until another valid receive. When a valid SIGNAL ACQUIRED does occur, U5-5 will remain high even during brief fades. This clean signal acquired on U5-5 is applied to U2-11.

In order to acquire receive busy at U2-8, three conditions must be met. The U2 pins 9, 10 and 11 must all be high. The SIGNAL ACQUIRED on pin 11 is high, if the radio is in receive; pin 9 is high if KEYLINE is not high. For instance, if data mode is selected, a KEYLINE of −6 volts from the system coming in on 1A2 J1-26 will cause a low at U19 pin 3 thus a high at U19 pin 1, (since U19-2 is low because the vocoder is not selected) and a high at U2-9. The U2-10 being at +5 volts requires that FULL OPERATE drops. Full operate will drop during a valid receive if a MISSS is received. The object of the U4 latch is to prevent receive busy from going to +6 volts on a false signal. Under normal operating situations, expect CHANNEL BUSY to become active when the radio receives a valid signal, a short time later a valid MISSS is received at the KG-36. Full operate from the KG-36 will fall, this will in turn cause U4 pin 15 to go low, causing U4 pin 13 to go high and thus U2 pin 10 to go high. With all three inputs to U2 being high the output of U2 is high. Thus U4-14 goes high and U4-13 is high, therefore U4-13 stays high, U11 inverts U2-8 to a low, and this low is again inverted into a true 188C signal being generated as RECEIVE BUSY to the data source on J1-29. When the end of the valid receive signal occurs, channel busy will drop approximately 20-miliseconds later. The U5 will fall to zero volts at that time, U2 pin 8 will fall to zero volts, this will cause U4 pin 14 to go to zero volts, the U4 latch to toggle, the U4-13 to go low, the input of U2-10 to be low and causing receive busy to remain low even if signal acquired goes high.

If the uhf mode of operation is selected by the rate switch on the OSDIU, then uhf receive clock will come onto 1A1 at J1-11 and be received by the 188C receiver U15. The positive logic receive clock will be generated on U15-15 and will be applied to U35-12, if the hf is not selected, then U8 pin 3 will be low and U8 pin 2 will be high and U35 pin 13 will be high and therefore U35 pin 11 will be an inverted U35 pin 12. The receive clock generated on U35-11 is applied to header pin B and also to the 188C driver U3. The U3 generates 188C clock to the submarine-satellite exchange. Receive clock to the stable clock circuit must be applied to U9 pin 14. This is the same point as header pin A. Normally header pin A will be strapped to header pin B, this is the receive clock. If the hf radio is selected by the rate control switch on the OSDIU, then hf RECEIVE CLOCK is used for receive clock. The hf receive clock is applied to board 1A1 at J1-37. The hf RECEIVE CLOCK is applied to U8 pin 1. The U8 pin 2 is a true logic TTL hf RECEIVE CLOCK. If hf is enabled at U8 pin 3, then U8 pin 2 will be active with receive clock, it will be applied to U35 pin 13 and appear inverted at U35 pin 11.

The remainder of the receive clock circuitry for this hf receive clock is as stated before, for the uhf receive clock. The U6 circuitry is used to divide receive clock by 8. This is required when operating with a 2400 baud line modem and transmitting 300 baud over a satellite or a uhf radio.

The stable clock circuit of FIG. 6*d* is required in order to have stable receive clock going to the KG-36 over periods of time when signal acquired or signal quality may fade at the receive radio. When the receive radios lose signal acquisition, receive clock will be jittery, thus possibly causing the KG-36 to to out of synchronization. Therefore when a valid signal is received on the uhf radio and CHANNEL BUSY is high or a valid signal is received on the hf radio, and signal quality is high, then the operation of the stable clock should be such that it will lock onto the receive clock and generate a stable receive clock. As soon as the valid receive disappears, then the stable clock allows the KG-36 to use clock of the same phase as when the receive clock from the radios was stable. The stable clock circuit will normally be able to function about 20 seconds before a complete 180 degree clock phase shift occurs. This is due to the inaccuracy of the oscillator used as Y1.

The hf receive data comes onto the 1A1 board at J1-24, and is received by U33-1. The uhf receive data comes into the 1A1 board at J1-25 and is received by U33-8. The hf half of U33 is enabled when pin 3 is at a logical one, and the uhf half of 33 is enabled when pin 12 is at a logical one. Whichever half of U33 is not enabled, it will have a high for an output, thus U32 pin 1 or 2 will not pay any attention to that half. The receive data that is enabled will come into U32, be inverted at U32-3 and be carried on over to U30 to be generated as receive data for submarine-satellite exchange going out J1-27 and at the same time going out J1-26 to the KG RDU, The 30 is a 188C driver, it inverts its input, the output is PM 6 volts the 33 uf capacitor serves to slow the rise and fall time. The KG-36 will decipher the RDI and output clear text on KG RDO. The KG RDO comes onto 1A2 at J1-2 and goes out to the vocoder as receive data, and out to the data source as receive data on J1-3 and J1-4, respectively.

The stable clock provides a phase stable data clock to the receiving crypto during momentary fades or receive interruptions. The stable clocks circuit utilizes the function VALID RECEIVE/ to determine that the receive clock from the radio is stable and is being derived from the receive data. When VALID RECEIVE/ is zero volts, it indicates that the receive clock is derived from and is phased locked to the receive data, when VALID RECEIVE/ is high, it indicates the radio is in a time and frequency search, and the receive clock is not on frequency or in phase with any reference. The stable clock circuit continuously provides internal generated receive clock and locked to the radio receive clock, providing VALID RECEIVE/ is zero volts. The stable clock circuit updates and corrects its output clock every 4th clock period to agree with the clock from the radio. When VALID RECEIVE/ is 5 volts, the stable clock circuit provides a free running stable clock output in phase with the last comparison to the clock from the radio. Thus the stable clock maintains a crypto synchronization during momentary signal losses. The operation of the stable clock circuit can be understood if one analyzes the circuit in its normal state, and then analyzes the circuit when it is correcting the clock.

During the discussion, it must be remembered that a JK flip flop (i.e., U18 and U22) functions as follows: if J is zerol while K is one, then Q will be 0. If J is 1 while K is 0, then Q will be 1. If both J and K are 1, then Q will toggle. The stable clock circuit will normally have +5 volts at U17-1 indicating no pulse, and +5 volts on U10-1 indicating no pulse. The output of U18-14 and U18-15 will be opposite. The input from J2-5 is the selected clock rate. Since U17-1 is normally at 5 volts, then U19-3 and U19-12 are both high causing U19-1 and U19-13 to be low. These two outputs are tied to U19-5 and U19-6, which cause a high on U19-4, which feeds U22-9 and causes U22-11 to toggle. The U22-11 will toggle at 614.4 KHz. This is derived by dividing the U21-9 1.2288 megahertz clock in half. Since U19-1 is normally low, then U22-4 is normally low, and since U22-16 is high, then U22-15 is at zero volts and thus U19-8 is at zero volts and U19-10 will simply be the inverse of U19-9 which is the 614.4 kilohertz. This 16.4 kilohertz is applied to the countdown circuitry, thus at U18-11 will appear 19 kilohertz. The 19 kilohertz applied to U11-14 is further counted down to the proper rates and applied to the front panel rotary switch. The desired rate is selected and applied to U23, the output of U11-8 is 400 Hz and is connected to U4-9 and is used for the line modem if required. During a short period of time as determined by the pulse width of the U17-1, a correction period will take place on the stable clock circuit. The 1A1 U9 divides receive clock by 4, when U9-9 goes low U10-1 generates approximately a 100 nanosecond pulse. A pulse is thus generated every fourth receive clock period. During this pulse, the clock at U20-14 will either be doubled (generated stable too slow) or it will be turned off (generated stable clock too fast).

The clock will always be too fast or too slow, never just right, i.e., the stable clock circuit is always correcting itself during the correction period. If U18-4 is low, i.e., J is low and K is high, then generated stable clock is considered too fast and the clock input at U20-14 will be stopped for the pulse duration of U17-1. This occurs because U18-15 is low and U18-14 is high, which causes U19-13 to be high and U19-1 to be low. This causes U19-4 to be low and U22-9 to be zero volts and which causes U22-11 to go low and removes the input to U19-9. Is U19-8 active No, since U19-2 is high, then U19-1 is low and U22-4 is low causing a low on U22-15 which means that U19-8 is also inactive. Therefore, no clock gets to the countdown circuitry, and a high, i.e., +5 volts is present on U20-14.

If the stable clock is too slow, the input to the countdown circuit doubles. This is because J18-4 and J18-16, which are J and K change from low and high to high and low, respectively, thus U18-14 becomes zero volts and U18-15 becomes 5 volts and the output of U19-1 and U19-13 changes from zero volts and 5 volts to 5 volts and 0 volts, respectively. That is U19-1 becomes 5 volts, U19-13 becomes zero volts, and U19-4 remains zero volts since U19-5 is at 5 volts. This causes U22-11 to remain low and therefore no input on U19-9. However, since U19-1 is now 5 volts then J of U22-8 is at 5 volts, and therefore U22-15 will toggle at one-half the input on U22-1. Since the input of U22-1 is at 2.4576 megahertz, then the output of U22-15 being applied to U19-8 is 122.88 kilohertz, and thus the frequency at U20-14 is double the normal 61.4 kilohertz, and thus stable clock speeds up. It is important to remember that these corrections by stopping or doubling the clock input to the count down circuit, occur only for the duration of the negative going pulse at U19-1, and that for the remainder of the receive operation the count down circuit is operating at 614.4 megahertz. The duration of the negative going pulse at U17-1 is determined by the front panel rate switch that switch either R4, R6, R7, R9, R10, R14, R16 or in series with C12, that time constant determines a negative pulse at U17-1. During the period of time that the valid receive is occurring on the uhf radio or the hf radio, then valid receive on U35-6 of 1A1 will be at +5 volts which causes U12-12 and U12-2 to go to zero volts. The system front panel lamp and the remote receive indicator 16 are turned on. The stable clock output is used to present stable clock to the KG-36. The KG CLOCK departs 1A1 at J1-30. The phase of J1-30 KG CLK is determined by the strap options connected to U32-10. Normally, the stable clock output will be tied to the input of the inverter U5 at pin 5. The output of U5 at U5-6 is then connected to U32-10 via strap J to H. During the period of time that U32-9 is enabled, U32-5 is disabled, and U32-6 will be at +5 volts, and therefore U13-11, 12, 13 will remain at +5 volts, and U13 will simply invert U13-10. The KG-36 uses the BLACK CLOCK from the stable clock to decypher data. The KG-36 generates gated clock which is connected to 1A2 at J1-33. It comes thru the U8 188C receiver and is applied to U13-13 via the strap on header 1 from pin 14 to pin 4 or pin 14 to pin 13.

In order to have receive clock being sent to the data source system, four signals must be present on U13. The U13-10 must be high, U13-11 must be high and U13-12 must be high along with the applied gated clock at U13-13. The U13-10 will be strapped via header 2 to pin 1 to pin 16 and tied to receive busy or U13-10 will be strapped to KEYLINE/ via header 2 pin 1 to pin 15. Thus if receive busy is high, then receive clock is permitted or in the second strap option as long as KEYLINE is inactive, receive clock will be enabled. The U13-11 will be enabled when data mode is selected. In the vocoder mode, U13-11 will be disabled therefore preventing receive clock from getting to J1 34. The U13-12 will be at +5 volts and enabled when the KG-36 deciphering data and generating clock, i.e., is when full operate is high.

The following describes the vocoder transmit function: if the front panel data/vocoder switch is in the vocoder position, then 1A2 J1-1 will be grounded. With J1-1 being at zero volts U13-11 will be at zero volts and disable data source RECEIVE CLOCK. The J1-1 being at zero volts, will also cause U17-9 to be at zero volts and the gated OS KEY/ at U17-8 to be disabled. Disabled means +5 volts, therefore U7-1 and U7-2 will always be at +5 volts and RED KEYLINE will follow GATED VOCODER KEYLINE/ presented on U7-3 and U7-4. A number of conditions must be met before GATED VOCODER KEYLINE/ can be activated. The first condition is that vocoder KEYLINE on J1-16 must be in the active state, which is +6 volts. The U16 will receive the +6 volts and present 0 volts when KEYLINE is active and give +5 volts when KEYLINE is inactive. This signal is applied to U15-12, U15-3 and U24-12. The U15-13 will go to +5 volts, if VOCODER KEYLINE is activated and vocoder mode is selected. The U17-11 will be allowed to go to 0 volts which is the active state for GATED VOCODER KEY/ only if receive busy is not active, i.e., U11-12 must be at 5 volts before the VOCDOER KEY OK from U15-13 will permit U17-11 to go to the active state of 0 volts. This will cause RED KEYLINE at J1-19 to be activated. At the same time, GATED VOCODER KEYLINE/ is inverted by U23 and applied U19-2. This causes U19-1 to go low since one of its inputs are at +5 volts. This low on U19-1 is applied to U2-9 and therefore causes receive busy at U2-5 to stay low and to perform the various functions described in AN/USQ-81 receive description.

Note that if the uhf or hf radio was busy receiving a valid signal and the KG-36 ran up and receive busy was active, then U17-12 would be at 0 volts and GATED VOCODER KEYLINE/ at U17-11 would remain at +5 volts and not allow any vocoder transmitting to occur. If a valid receive is in process, then GATED VOCODER KEYLINE is allowed, which will cause RECEIVE BUSY/ at U11-12 to go high meaning the inactive state, and this high is fed back around to U17-12 which allows VOCODER KEYLINE to activate the KEYLINE transmit circuitry on the black printed circuit board 1A1.

The front panel switch being in vocoder mode, causes 1A2 J1-1 to be at 0 volts and will turn off U17-6 because U17-5 will be at 0 volts. This low at J1-1 is inverted by U23 pins 1 and 2 to enable U17-3, thus the vocoder transmit data is supplied to U21-1 and is received by this 188C receiver and presented to U17-1. The output of which on U17-3 is applied to U18-3 and U18-4 and generating TDI at J1-25. A busy tone will occur in the ear piece of the vocoder handset, if it is keyed and the hf or uhf radio is in the middle of a valid receive. If the hf or uhf radio is not in the middle of a valid receive then a steady dial tone will occur, and when the dial tone goes away the vocoder operator may speak, the operation voice will then be digitized and encyphered and transmitted.

Vocoder tone of approximately 1 kHz is generated by one-half of U20. The other half of U20 is an oscillator of approximately 1 Hz. If receive is busy then the 1 hertz oscillator is used to interrupt the 1 kHz oscillator. If the vocoder is not selected and an operator attempts to transmit on the vocoder U15-9 will be at 30 5 volts. This high, regardless of what U15-8 is, will cause U15-10 to be low. The U15-6 being low will allow the 1 hertz oscillator being presented on U15-5 to be inverted and appear at U15-4. This implies that U15-2 will be oscillating at approximately a 1 hertz rate. Therefore when the operator keys the vocoder, U16-13 will go low which causes U15-3 to be low while U15-2 is oscillating and this condition causes U20-4 to toggle up and down at approximately 1 hertz and therefore enable and then disable the 1 kilohertz oscillator serving as vocoder tone. The 1A2 J1-23 is VOCODER RECEIVER INHIBIT/. If this signal is at −6 volts, then the vocoder receiver is inhibited and the vocoder will respond to VOCODER TONE being generated on J1-12 and not to the digital input which comes from 1A2 J1-3.

During the period of time that VOCODER RECEIVER INHIBIT/ is at −6 volts, the vocoder will be receiving the busy tone of J1-12. As soon as the operator releases the vocoder KEYLINE, the busy tone will go away and U15-3 will go to +5 volts and therefore cause U20-4 to be in the reset mode and the tone generator will be turned off. When the vocoder is selected, U15 pin 9 is at 0 volts and therefore U15-10 will be the inverse of whatever U15-8 is. It follows that if a receive is in process, that RECEIVE BUSY on U15-8 will be high causing U15-10 to be 0 volts. Likewise U15-6 is enabled with the 0 volts and the 1 hertz oscillator will turn on and off the 1 kilohertz oscillator as described previously. Assuming that a receive is not in process and that the vocoder is selected, when the operator picks up the vocoder handset and pushes the push-to-talk button raising KEYLINE, this KEYLINE will proceed on through U16, U15 and finally U17-11 as previously discussed. For the first part of a vocoder transmit the vocoder is told to transmit frames only. During the period of time that the transmitter is keyed and the KG-36 is not the output of vocoder transmit frame from U25-9 is a don't care function.

However, when the KG-36 is prepped, it means that the uhf or hf radio is ready to transmit data. The first data that the KG-36 has to transmit is the crypto MISSS. After a valid MISSS, then it is ready to transmit encyphered data. The vocoder is to transmit frames for approximately 200-milliseconds in order to set up the receive vocoder. The vocoder will transmit frames when U25-9 is at −6 volts. Upon the KG-36 full operate on 1A2 J1-35 going to a logical 1 after prep then FULL OPERATE/ being generated at U8-2 is applied to U1-1 and U1-2. This allows the transistor of U1 to turn off and for C1 to charge thru R1 during the period of time that the trigger/threshold of U3 is below $\frac{2}{3}$ Vcc. The U3-5 is at +5 volts and a TTL TRANSMIT FRAMES condition exists. This is inverted by U23 at pin 12 and finally transmitted by the 188C driver U25-9 and will cause the vocoder to transmit frames.

Approximately 200-milliseconds after C1 starts to charge the trigger/threshold of U3 will reach ⅔ Vcc, which will cause U3-5 to go to 0 volts which will cause the TTL transmit frames to go to logical 0 and thus U23-12 to go to +5. Which means U25-9 will go to −6 volts and the vocoder will be told to transmit digitized voice. The vocoder tone will be listened to by the vocoder until J1-23 goes to +6 volts, allowing received digitized voice to go to the headset ear piece. Since at this time KEYLINE is permitted, then receive busy will be forced to 0 volts, U24-13 will be at 0 volts, the TTL VOCODER KEYLINE/ will be active and thus U24-12 will be forced to 0 volts. Either U24-12 and U24-13 being at 0 volts will cause U24-11 to be at +5 volts. Since U24-10 is at 0 volts during transmit frames, then U24-4 and U24-5 are both high and a low occurs at U24-2. Which means a high will occur at U24-3. The +5 volts on the input to U25 will cause U24-5 to go to −6 volts. When U3-5 finally goes to 0 volts at the end of TTL XMT FRAMES, then the vocoder will be told to transmit digitized voice by U25-9 going to −6 volts. This implies that U23-12 has got to go to +5 volts. The +5 volts on U24-10 along with +5 volts on U24-9 which is present because U19-5 and U19-6 are both at 0 volts, because of KEYLINE being activated and PREP being activated, will cause a low on U24 pin 8. Thus a low will also be present on U24 pin 5 and will cause U24-6 to go to +5 volts. The +5 volts on U24-2 and the +5 volts on U24-1 which is present because U19-8 and U19-9 are both at 0 volts, because full operate is active and vocoder select is active, that is at 0 volts, then U24-3 will go to 0 volts causing vocoder receiver inhibit to go to +6 volts.

Thus, during the transmit mode after 200-milliseconds of TRANSMIT FRAMES ONLY, the vocoder tone from the ear piece will go away and a low side tone will be present of what is being transmitted. The VOCODER TRANSMIT CLOCK will be active at all times since the gated clock is simply tied to U22-5 via the strap on header 1. The transmit portion of the vocoder on card 1A1 is identical to the transmit portion of USQ-81.

The vocoder transmit function is as follows: during a valid receive the CRYPTO FULL OPERATE will be activated and RECEIVE BUSY at U2-8 will go high as discussed under AN/USQ-81 receive. This high is applied to U24-13 and will cause U24-11 to go to zero volts since U24-12 is at +5 volts and since vocoder KEYLINE is not activated. The U14-11 being zero volts is applied to U24-4. The U24-4 at zero volts will cause U24-6 to to go +5 volts and appear at U24-2. The U24-1 is already at +5 volts since U19-8 is at zero volts, since the vocoder is selected and U19-9 is at zero volts since the crypto is in full operate.

Thus, with U24-1 and U24-2 at +5 volts then U24-3 will be at zero volts. This causes U25 to drive to +6 volts and thus puts the vocoder into a receive function, i.e., it removes RECEIVER INHIBIT/ at J1-23. Only two other conditions are required for a valid receive to take place in the vocoder: (1) the vocoder receive proper clock and (2) the vocoder search for sync signals. The VOCODER SYNC SRCH INH/ on J1-5 will remain at +6 volts at all times due to the zener effect of CR4. This +6 volts removes the VOC SYNC SRCH INH/ signal. The J1-5 would more properly be called ARCH FOR SYNC. The VOCODER RECEIVE CLOCK is present at all times and gated clock from the KG-36 is present. This is due to the received gated clock passing right on to U22 through header 1 pins 1 and 16 or pin 2 and pin 16.

The final function, the submarine-satellite information exchange operates as follows: when the front panel OS/SSIXS switch is selected to the SSIXS position. The system is in uhf mode and the transmit functions of the vocoder or data source are disabled. The circuitry of U34 and U4 will accept either a PM 6 volt KEYLINE signal on J1-15 or a KEYLINE/ signal from J1-35.

If the J1-15 signal is utilized, S1-C4 must be in the off position and S2 must be in the off position. This allows +6 volts to key the uhf transmitter and −6 volts to unkey the uhf transmitter.

If SSIXS KEYLINE/ of J1-35 is utilized, the S1-C4 and S2 must be in the ON position. This will allow a ground condition being presented at J1-35 to key the uhf transmitter or an open condition on J1-35 to allow a non-transmit condition.

This KEYLINE information is applied to U24-1 and if SSIXS is enabled U24-2 will be at +5 volts and U24-3 will be the inverse of U24-1. This SSIXS KEYLINE/ from U24-3 is applied to U36 and U27 causing J1-3 to go to +6 volts during a key condition, and go to −6 volts during a no key condition. It likewise will cause J1-1 to go to ground during a KEYLINE condition and float or open circuit during a no KEYLINE CONDITION. Transmit clock is forwarded to SSIXS via J1-19.

How transmit clock gets to the input of U3 is discussed in the data source data transmit description above. The uhf receive data is likewise continuously applied to U30 pins 1, 2, 3, and 4. This applies the same 188C receive data at J1-27 as is seen at J1-25. The data source and vocoder are not allowed to transmit when the system is in the submarine-satellite mode.

Obviously many modifications and variations of the present invention are possible in the light of the above teachings. It is therefore to be understood that within the scope of the appended claims the invention may be practiced otherwise than as specifically described.

What is claimed is:

1. A system for interfacing unclassified information and classified information to and from a pair of discrete radio links comprising:

means for generating and receiving classified and unclassified tactical data;

means for generating and receiving classified and unclassified voice coded data;

means coupled to the tactical data generating and receiving means and the voice coded data generating and receiving means for encrypting information sent therefrom and for decrypting information sent thereto;

first means coupled to the encrypting and decrypting means, the tactical data generating and receiving means and the voice coded data generating and receiving means for transmitting and receiving information to satellites in the high frequency spectrum;

means coupled to the encrypting and decrypting means, the tactical data generating and receiving means and the voice coded data generating and receiving means for transmitting and receiving information in the ultra-high frequency spectrum;

means for connecting either the tactical data generating and receiving means or the voice coded data generating and receiving means to the encrypting and decrypting means; and means operatively coupled for providing power for the system.

2. A system according to claim 1 further including:

means coupled between the encrypting and decrypting means and the first high frequency transmitting and receiving means and the ultra-high frequency transmitting and receiving means for coupling either to the encrypting and decrypting means, the connecting means and the coupling means cooperate to separate a red side of the encrypting and decrypting means from its black side.

3. A system according to claim 2 further including:

means for providing a submarine satellite communication system and means connected to the first high frequency transmitting and receiving means and the second ultra-high frequency transmitting and receiving means for selectively disconnecting the encrypting and decrypting means and for connecting the submarine-satellite communication system means to the second ultra-high frequency transmitting and receiving means.

* * * * *